US011059085B2

(12) United States Patent
Miyagi et al.

(10) Patent No.: US 11,059,085 B2
(45) Date of Patent: Jul. 13, 2021

(54) MANUFACTURING METHOD AND MANUFACTURING APPARATUS FOR PRESS-FORMED ARTICLE

(71) Applicant: NIPPON STEEL CORPORATION, Tokyo (JP)

(72) Inventors: Takashi Miyagi, Tokyo (JP); Yasuharu Tanaka, Tokyo (JP); Misao Ogawa, Tokyo (JP); Toshimitsu Aso, Tokyo (JP); Takashi Yamamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 186 days.

(21) Appl. No.: 16/339,496

(22) PCT Filed: Oct. 5, 2017

(86) PCT No.: PCT/JP2017/036350

§ 371 (c)(1),
(2) Date: Apr. 4, 2019

(87) PCT Pub. No.: WO2018/066663

PCT Pub. Date: Apr. 12, 2018

(65) Prior Publication Data

US 2020/0038931 A1 Feb. 6, 2020

(30) Foreign Application Priority Data

Oct. 5, 2016 (JP) ..... JP2016-197463

(51) Int. Cl.
*B21D 5/01* (2006.01)
*B21D 22/26* (2006.01)
*B21D 24/10* (2006.01)

(52) U.S. Cl.
CPC ..... *B21D 5/01* (2013.01); *B21D 22/26* (2013.01); *B21D 24/10* (2013.01)

(58) Field of Classification Search
CPC ..... B21D 22/26; B21D 22/20; B21D 22/22; B21D 22/24; B21D 24/00; B21D 24/04;
(Continued)

(56) References Cited

U.S. PATENT DOCUMENTS 4,479,372 A 10/1984 Watanabe
2012/0324974 A1* 12/2012 Nakamura ..... B21D 22/22 72/305

(Continued)

FOREIGN PATENT DOCUMENTS

CN 104364030 B 11/2015
JP 11-239827 A 9/1999

(Continued)

OTHER PUBLICATIONS

Russian Decision to Grant and Search Report for corresponding Russian Application No. 2019112723/02 dated Oct. 25, 2019, with an English translation.

(Continued)

*Primary Examiner* — Adam J Eiseman
*Assistant Examiner* — Bobby Yeonjin Kim
(74) *Attorney, Agent, or Firm* — Birch, Stewart, Kolasch & Birch, LLP

(57) ABSTRACT

The manufacturing method includes a first step in which a pad holding state is established and a second step in which pad draw forming is performed after the first step is completed. In the pad holding state, (a) a part of a blank 15 to be formed into a top plate 21 is held between a pad 13 and a punch 11, and a part of the blank 15 to be formed into a flange 25 is held between a die 14 and a blank holder 12, (b) in a specific press directional cross section of a part of the blank 15 to be formed into a first part, the position of the contacting surface of the blank holder 12 that makes contact with the blank 15 in the direction of pressing is located (Continued)

toward the punch 11 in the direction of arrangement of the pad 13 and the punch 11, compared with the position of the contacting surface of the pad 13 that makes contact with the blank 15 in the direction of pressing, (c) a vertically-reversing cross-sectional angle is more than 0° and equal to or less than 80°, and (d) in a press directional cross section that is different from the specific press directional cross section, the position of the contacting surface of the pad 13 that makes contact with the blank 15 in the direction of the pressing is located toward the pad 13 in the direction of the arrangement, compared with the position of the contacting surface of the blank holder 12 that makes contact with the blank 15 in the direction of pressing.

6 Claims, 16 Drawing Sheets

(58) Field of Classification Search
CPC ..... B21D 24/06; B21D 24/08; B21D 24/10; B21D 24/12
See application file for complete search history.

(56) References Cited

U.S. PATENT DOCUMENTS

| | | | | |
|---|---|---|---|---|
| 2013/0064998 | A1* | 3/2013 | Wnek | B21D 22/26 428/34.1 |
| 2015/0174634 | A1* | 6/2015 | Nishimura | B21D 22/26 72/343 |
| 2015/0273563 | A1* | 10/2015 | Miyagi | B62D 25/04 29/897.2 |
| 2015/0336158 | A1 | 11/2015 | Miyagi et al. | |
| 2015/0367392 | A1* | 12/2015 | Nishimura | B21D 22/20 72/379.2 |
| 2016/0375477 | A1 | 12/2016 | Tanaka et al. | |
| 2017/0066036 | A1* | 3/2017 | Bruggenbrock | B21D 53/88 |
| 2018/0126433 | A1* | 5/2018 | Ogawa | B21D 22/26 |

FOREIGN PATENT DOCUMENTS

| | | | |
|---|---|---|---|
| JP | 2005-262309 | A | 9/2005 |
| JP | 2009-255116 | A | 11/2009 |
| JP | 2012-51005 | A | 3/2012 |
| JP | 2014-240078 | A | 12/2014 |
| JP | 2015-81036 | A | 4/2015 |
| JP | 2015-110237 | A | 6/2015 |
| JP | 5728334 | B2 | 6/2015 |
| RU | 2057606 | C1 | 12/1987 |
| SU | 1360576 | A3 | 12/1986 |
| TW | 201422332 | A | 6/2014 |
| TW | 201501830 | A | 1/2015 |
| WO | WO 2014/106931 | A1 | 7/2014 |
| WO | WO 2015/098871 | A1 | 7/2015 |
| WO | WO 2014/050973 | A1 | 11/2015 |

OTHER PUBLICATIONS

First Office Action for TW 106134406 dated Aug. 27, 2018.
International Search Report for PCT/JP2017/036350 dated Dec. 12, 2017.

* cited by examiner

[Fig.1A]
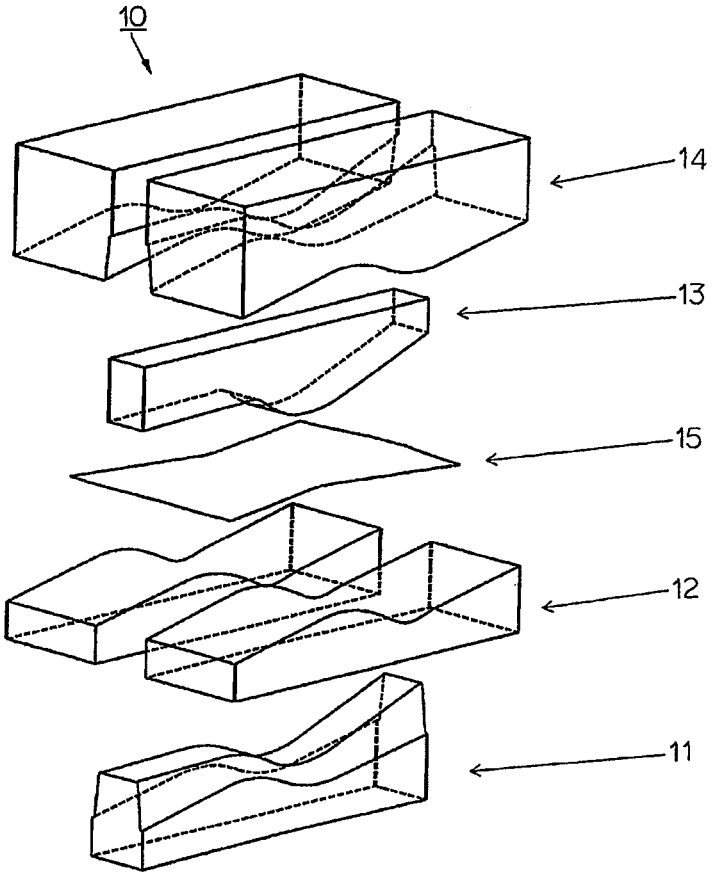

[Fig.1B]
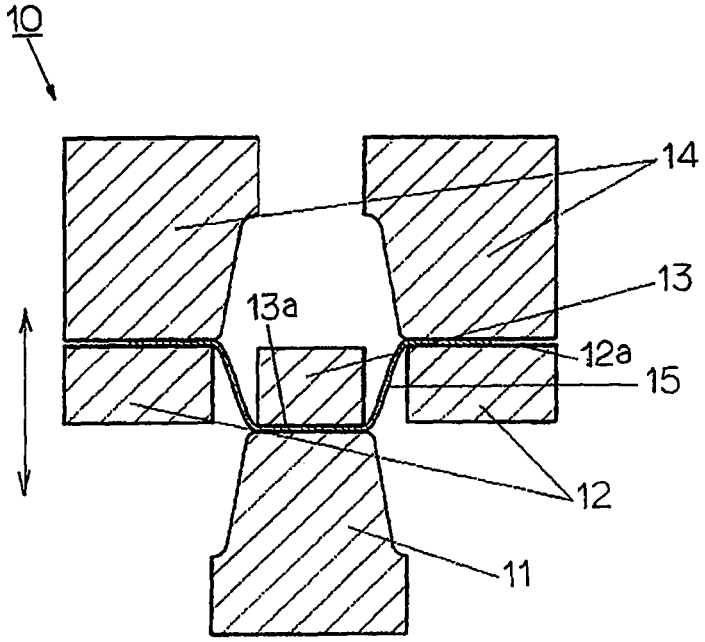
[Fig.1C]
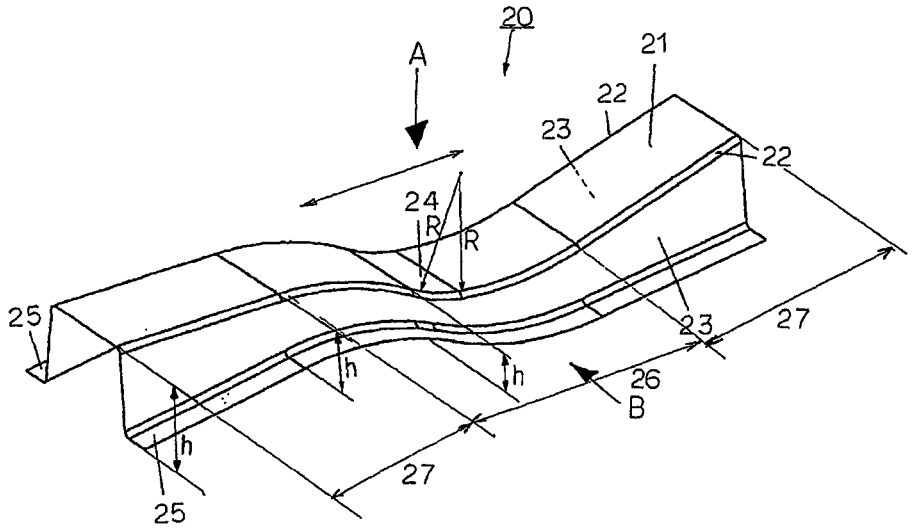

[Fig.2A]
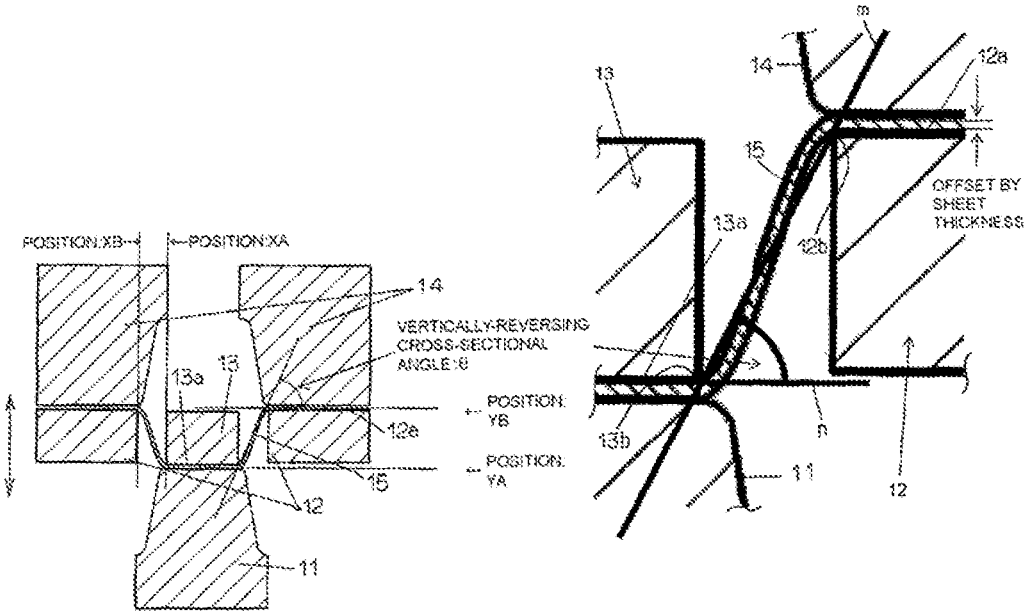
[Fig.2B]
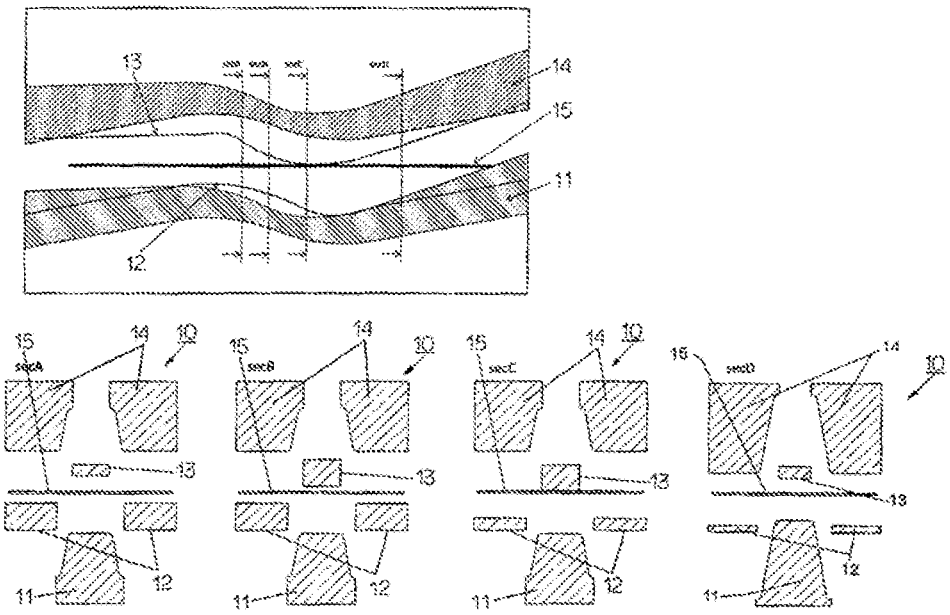

[Fig.2C]
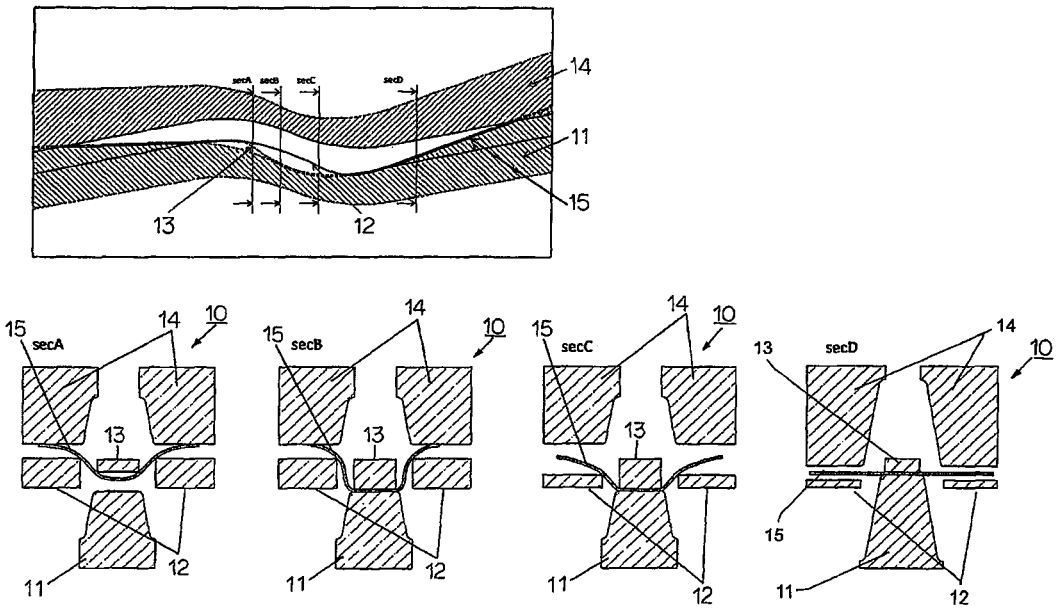
[Fig.2D]
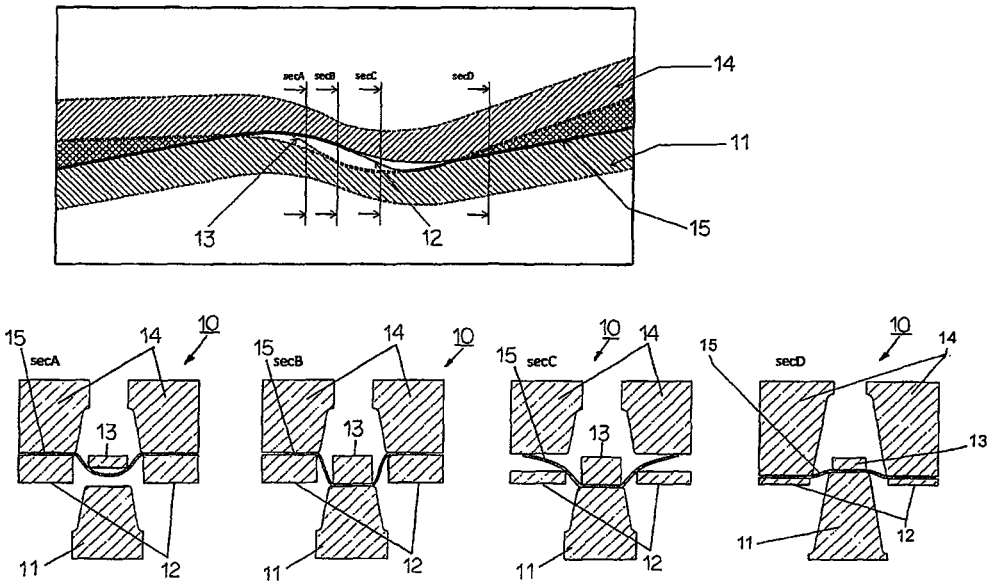

[Fig.2E]
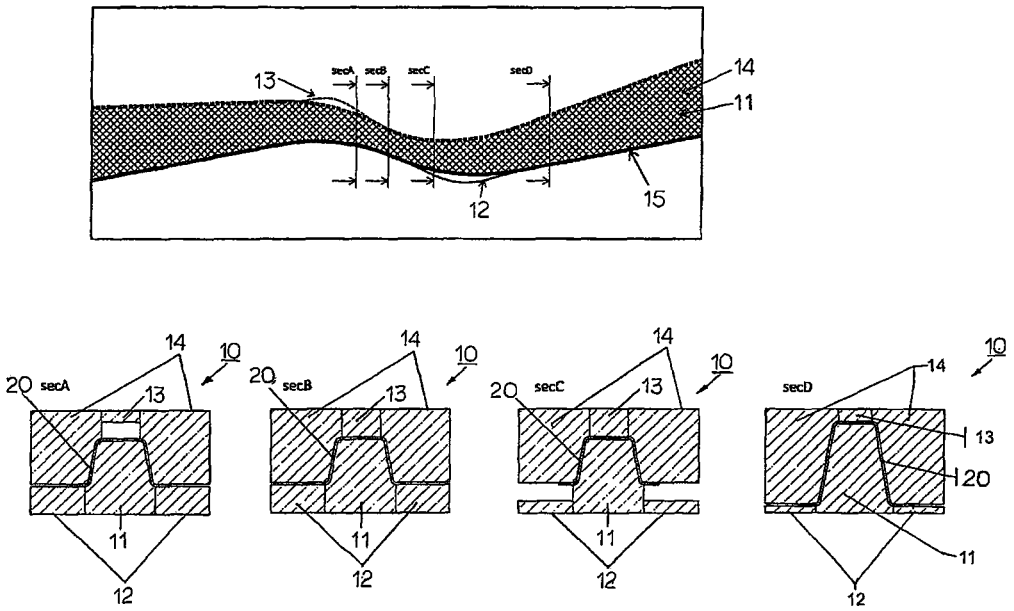
[Fig.3]
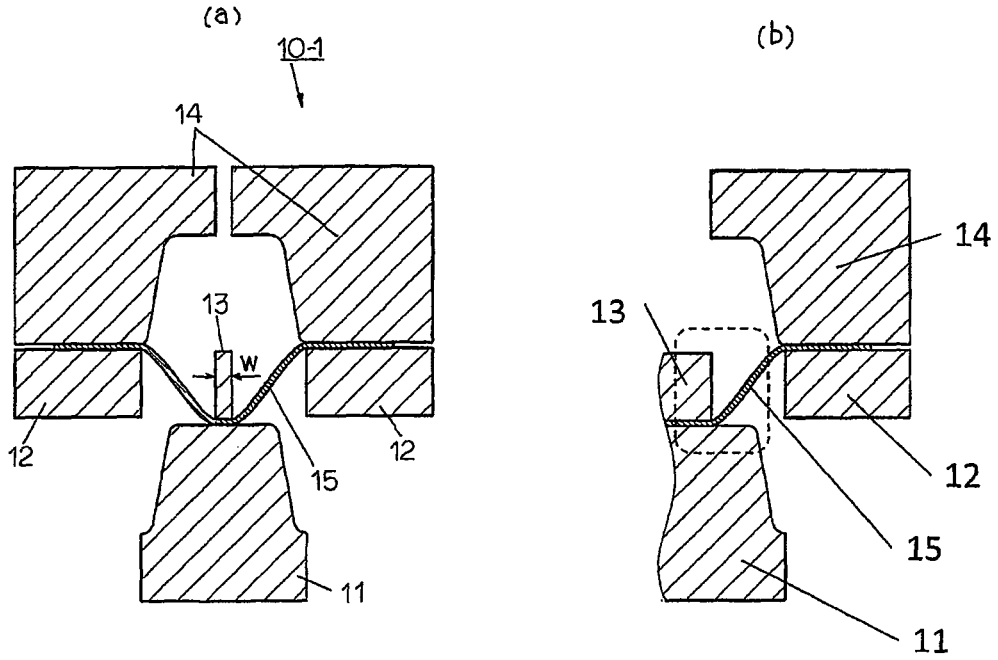

[Fig.4]
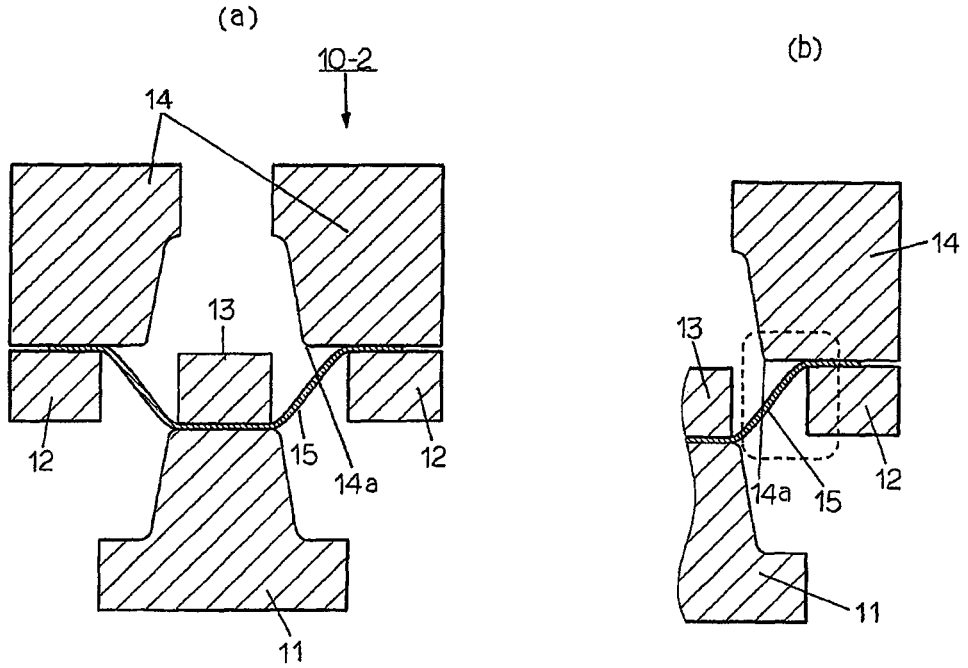
[Fig.5]
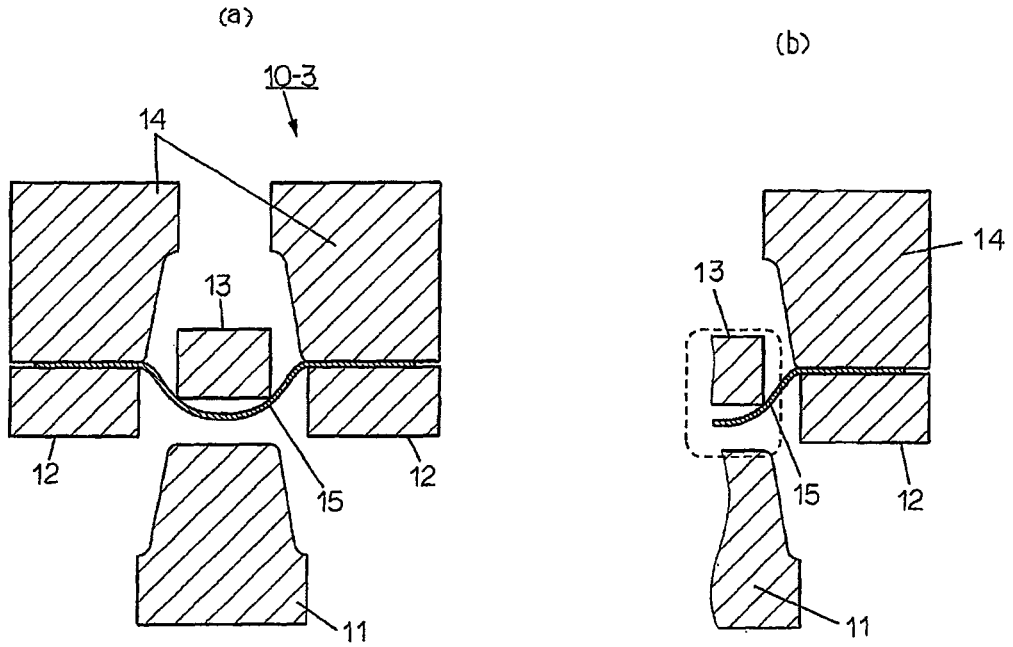

[Fig.6]
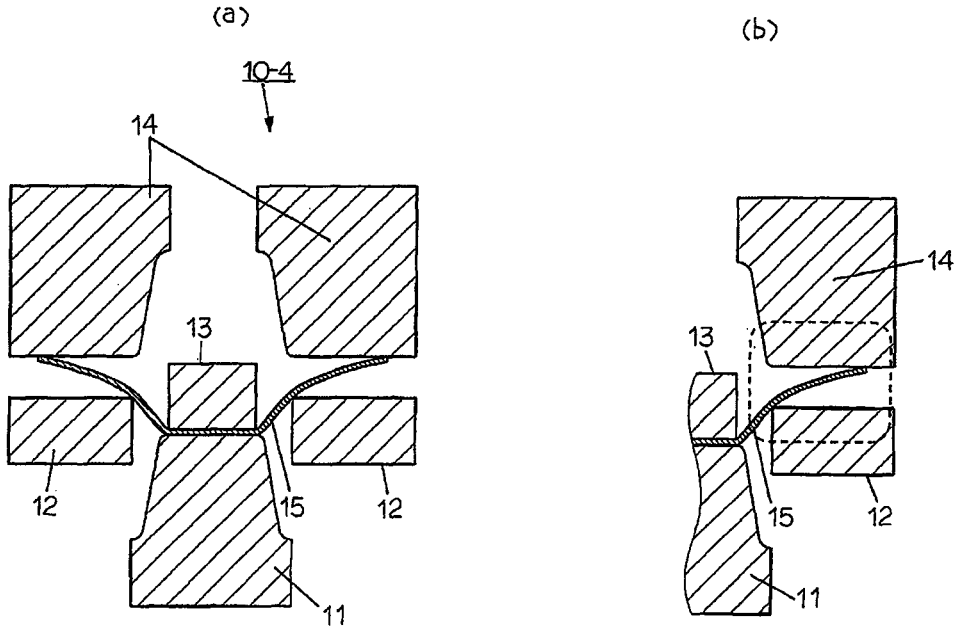
[Fig.7]
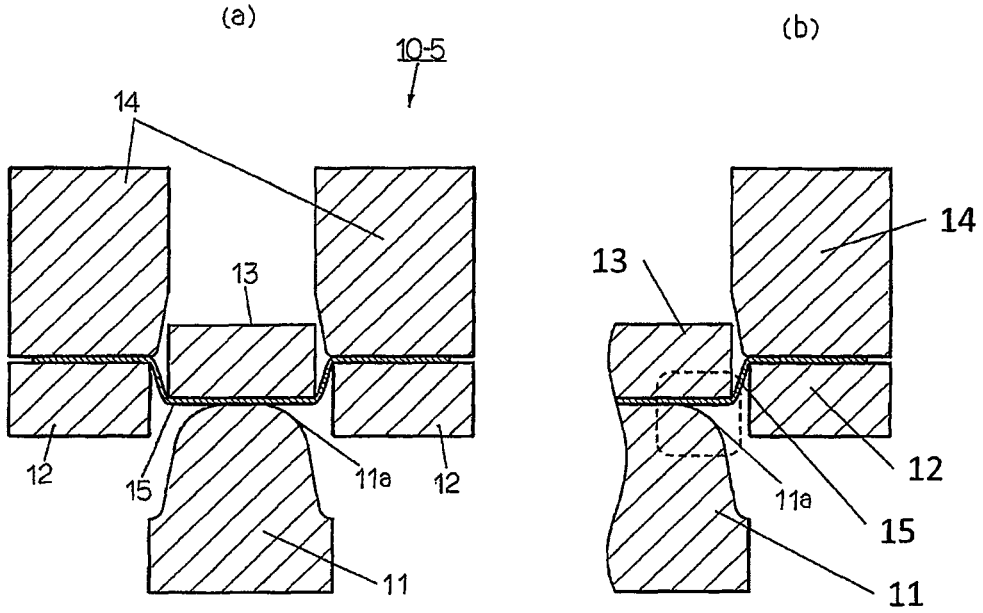

[Fig.8]
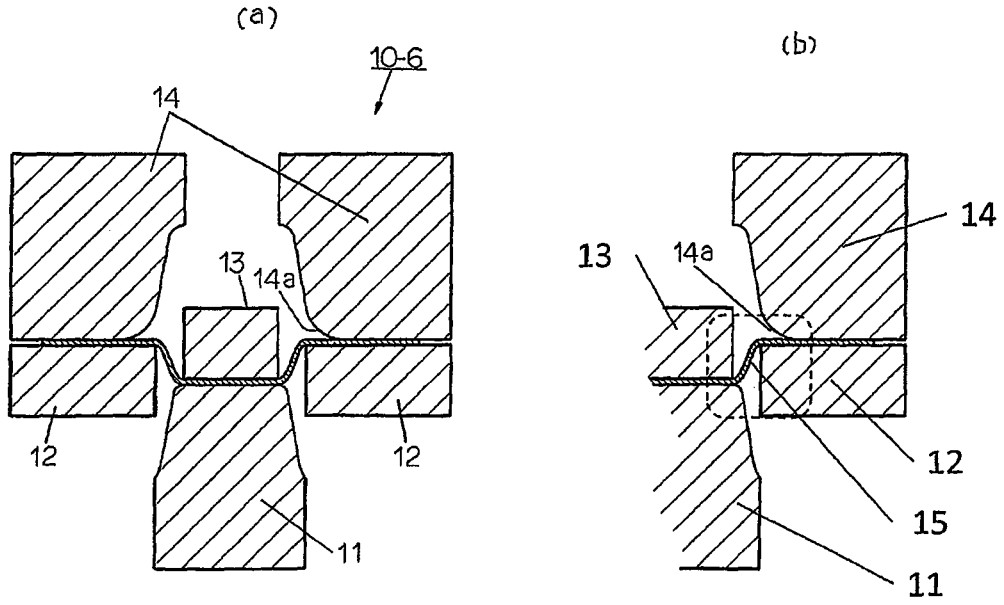
[Fig.9]
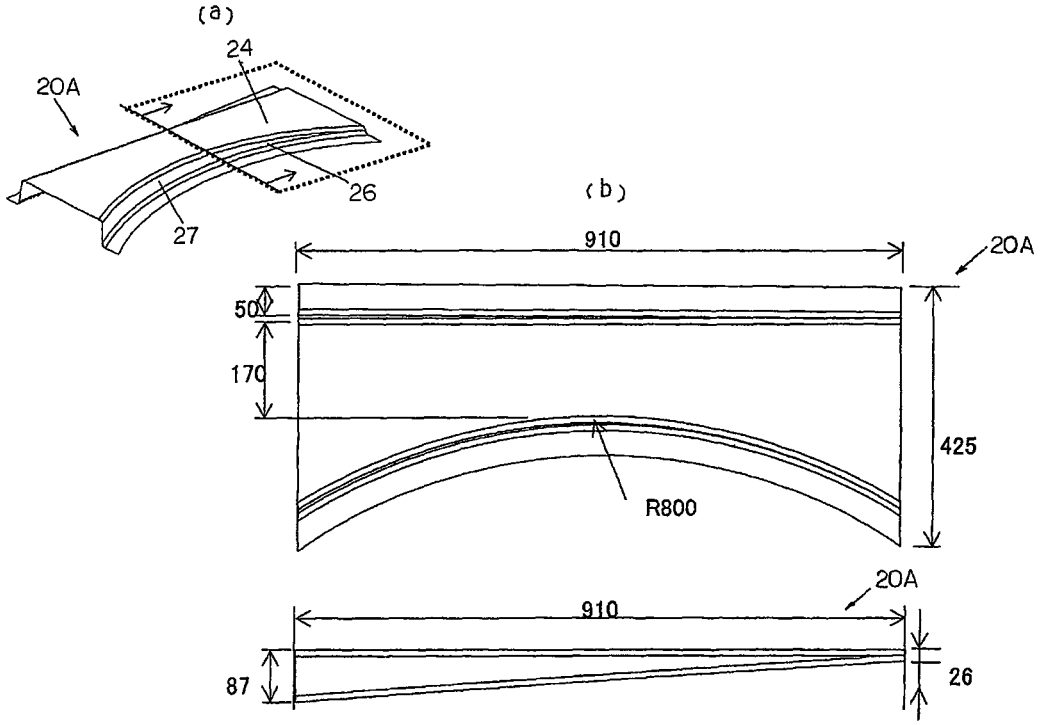

[Fig.10]
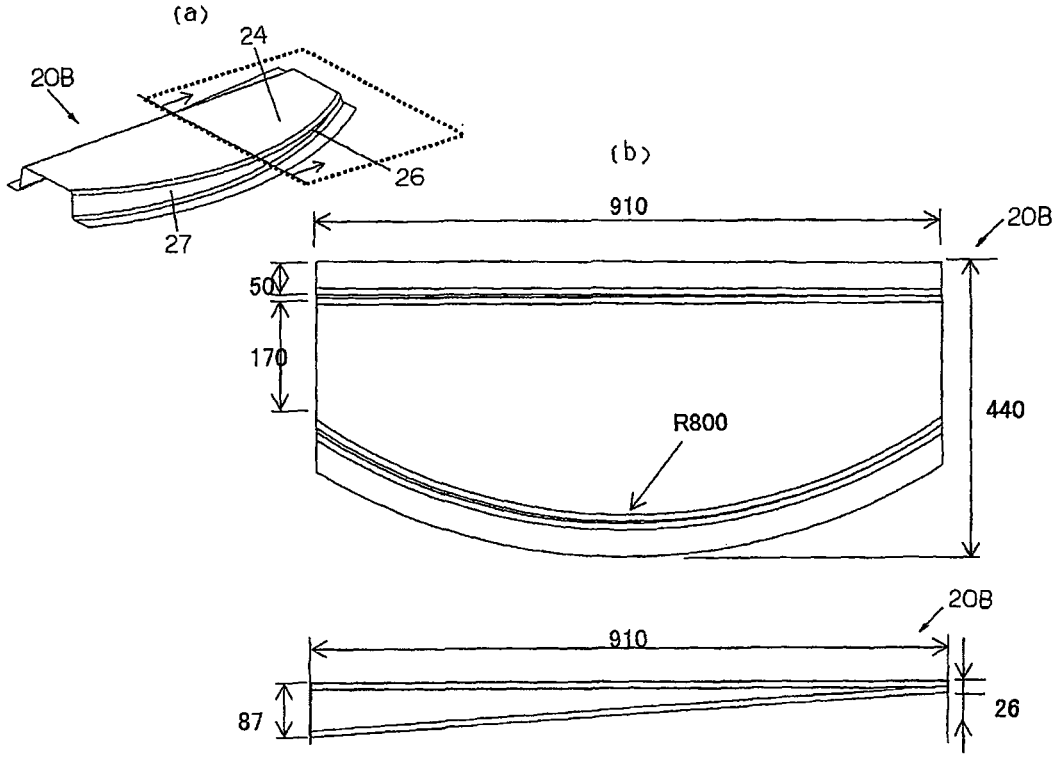
[Fig.11]
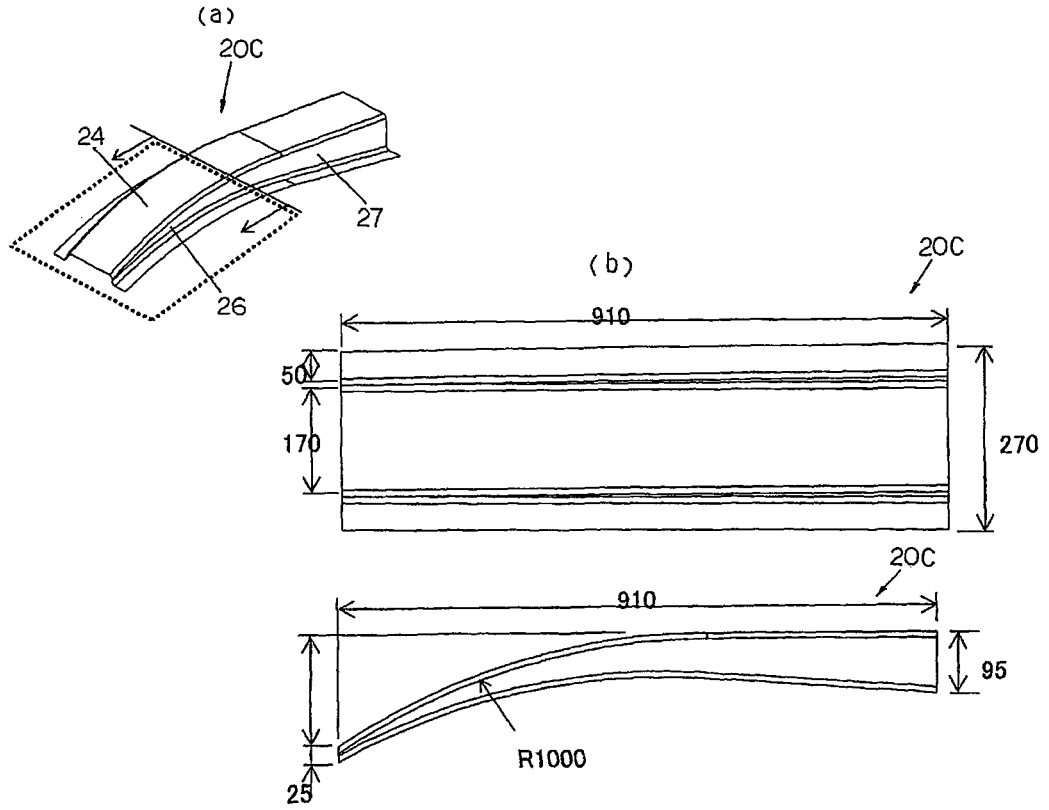

[Fig.12]
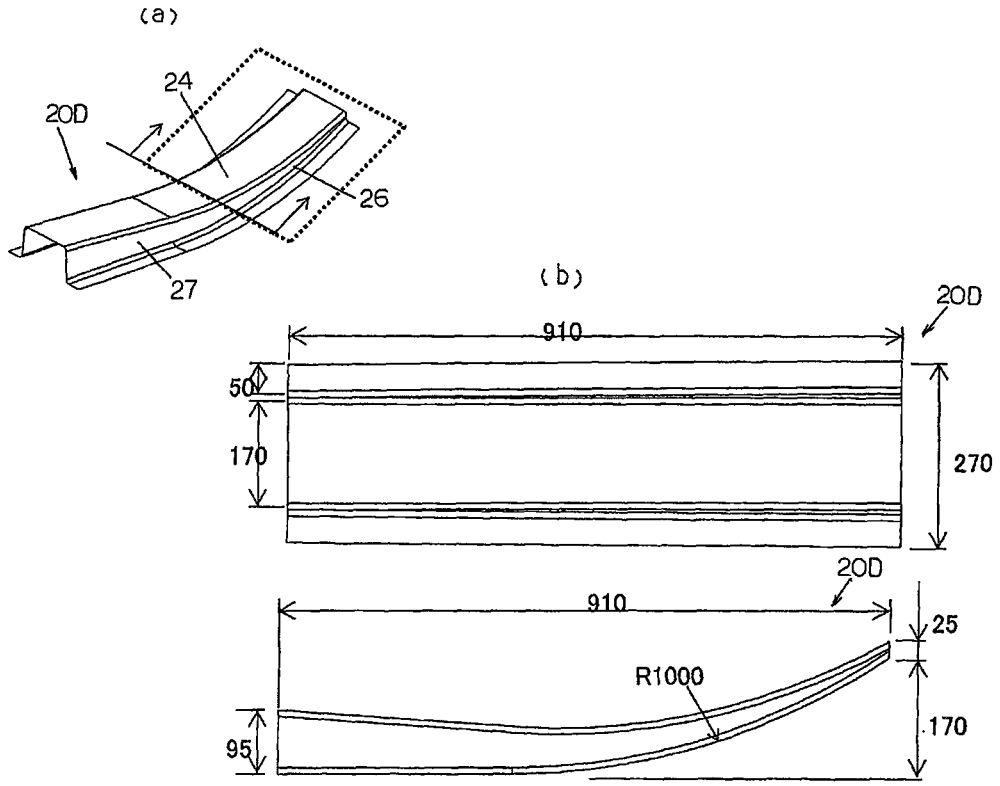
[Fig.13]
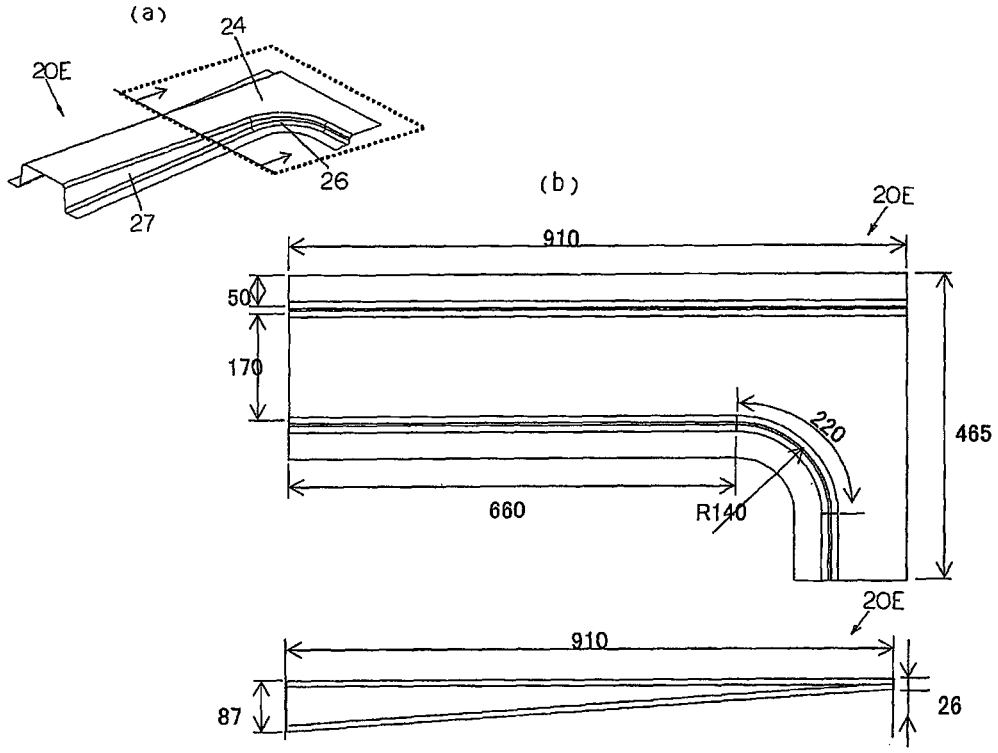

[Fig.14]
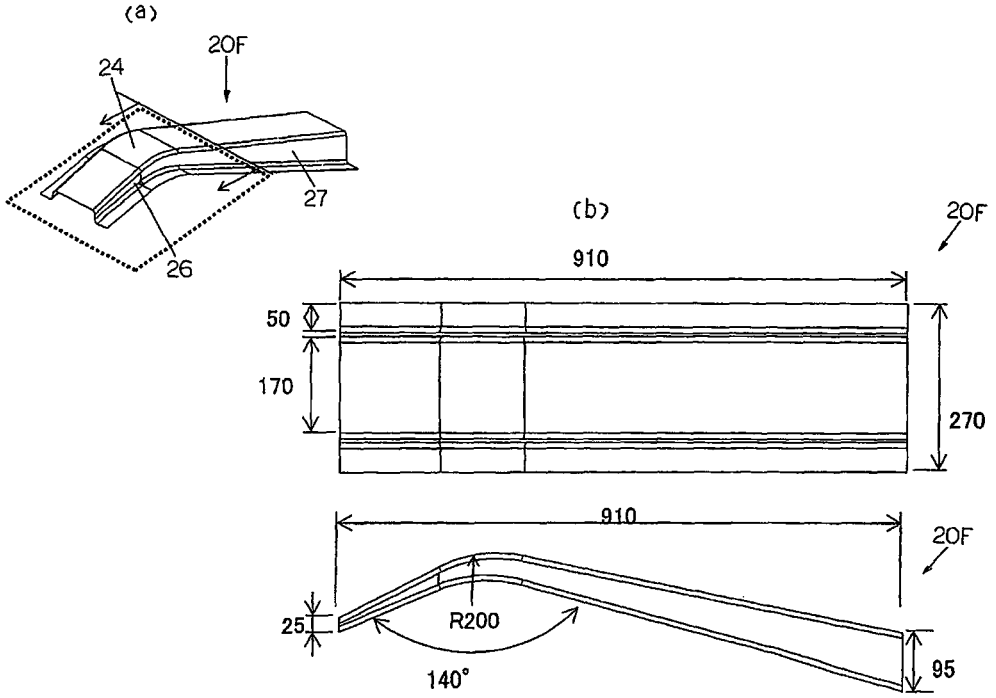
[Fig.15]
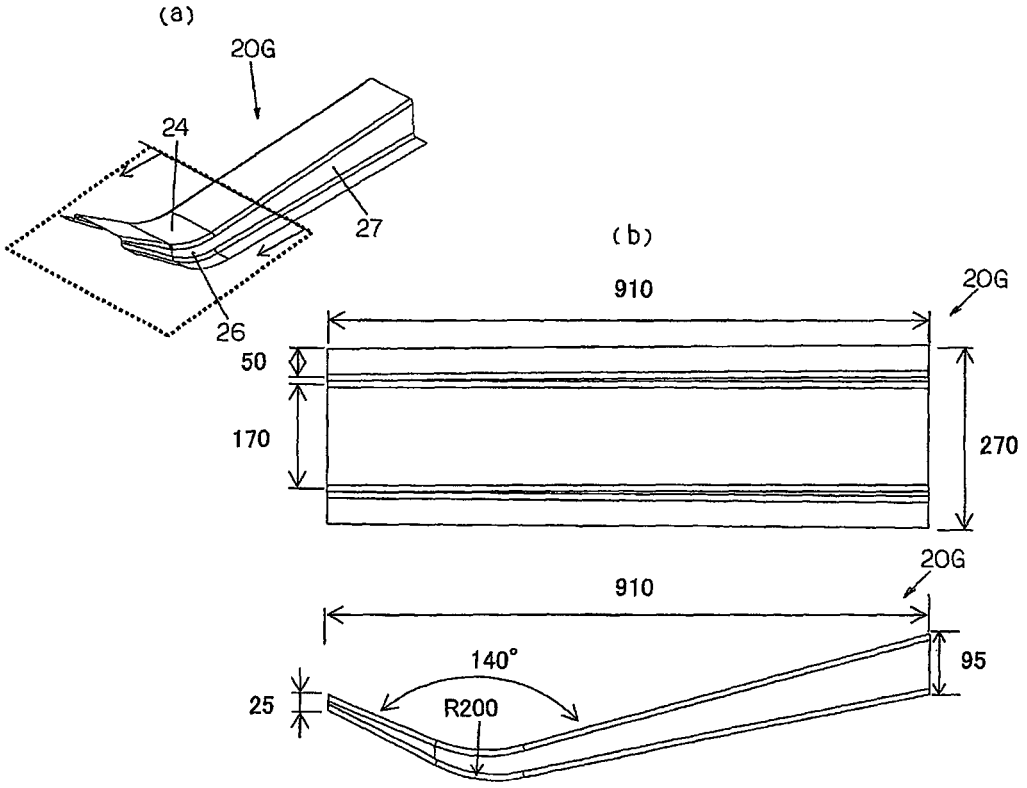

[Fig.16]
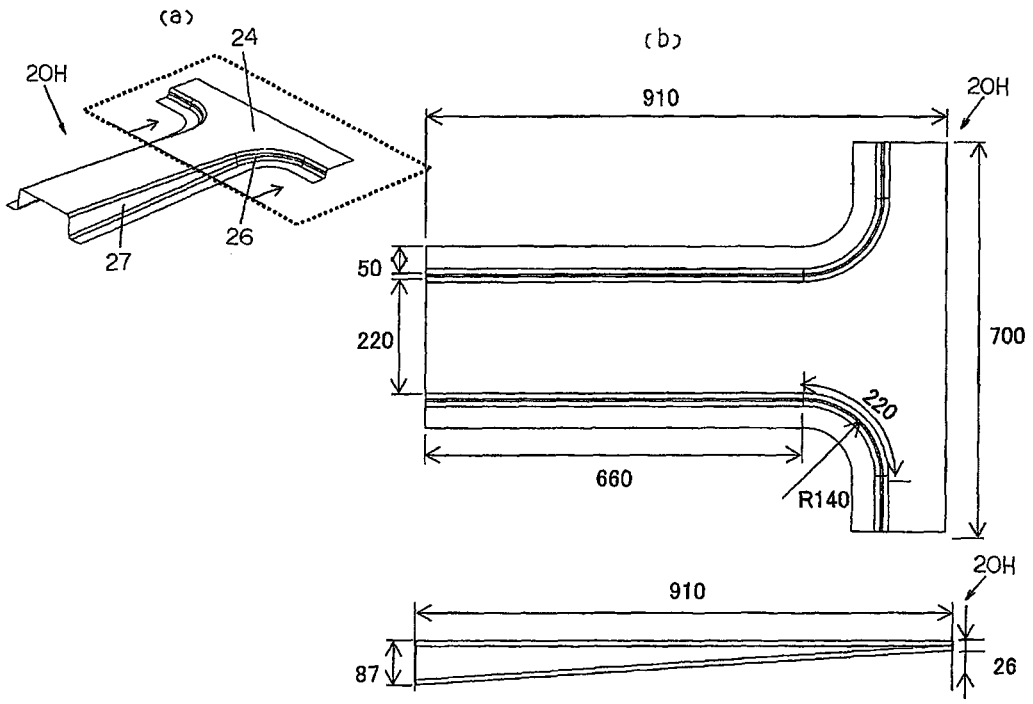
[Fig.17]
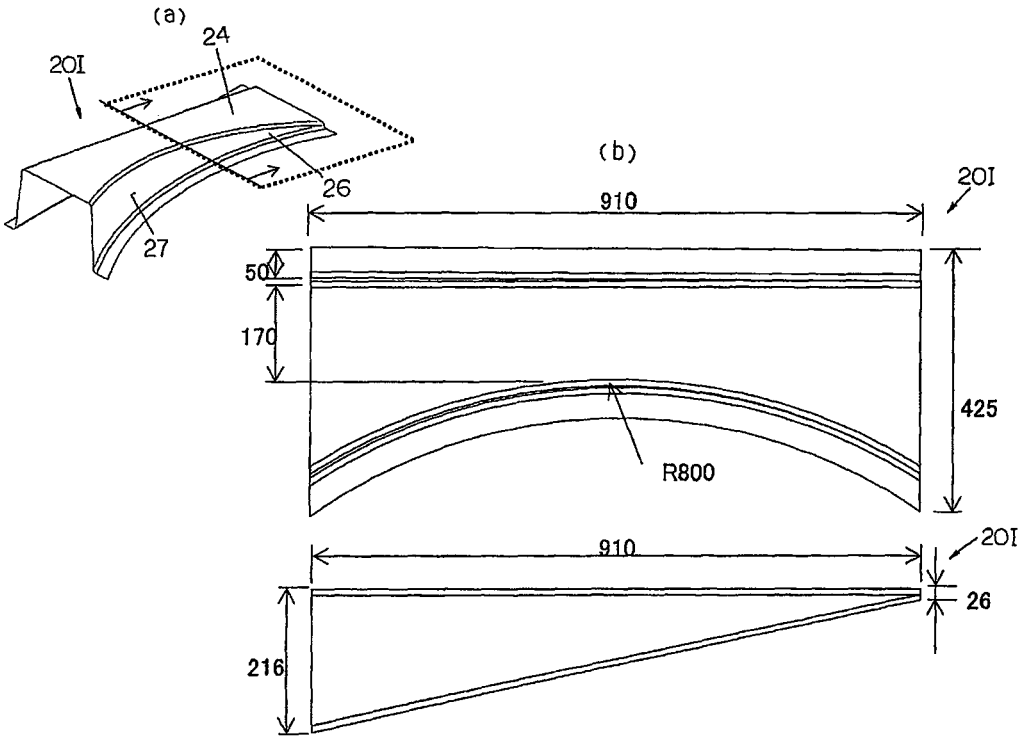

[Fig.18]
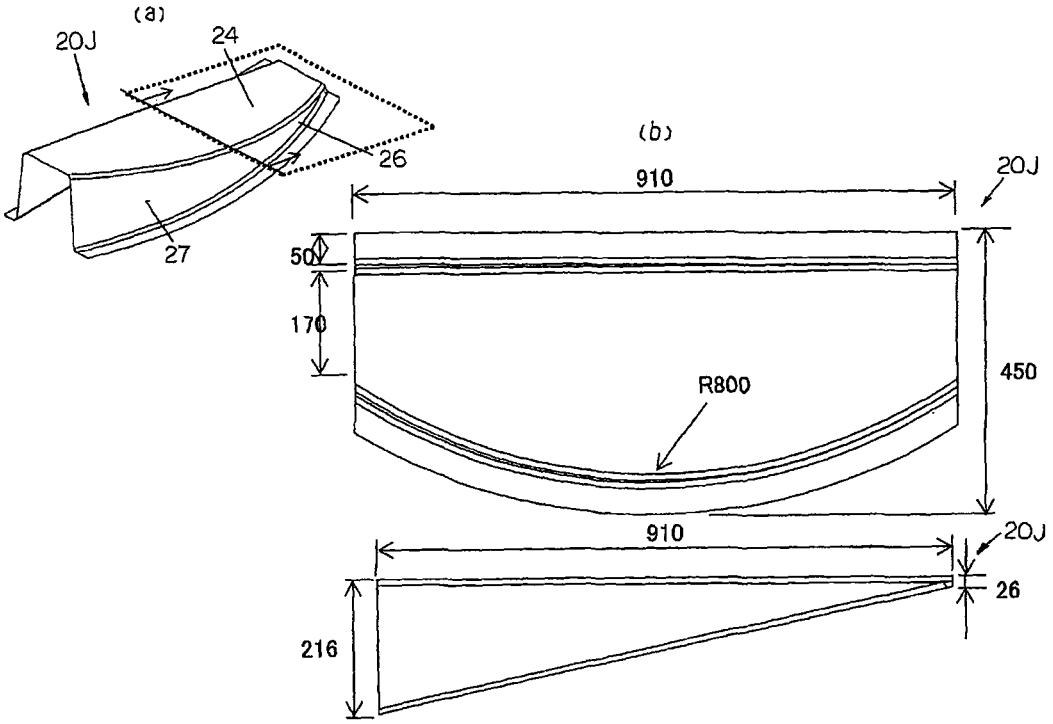
[Fig.19]
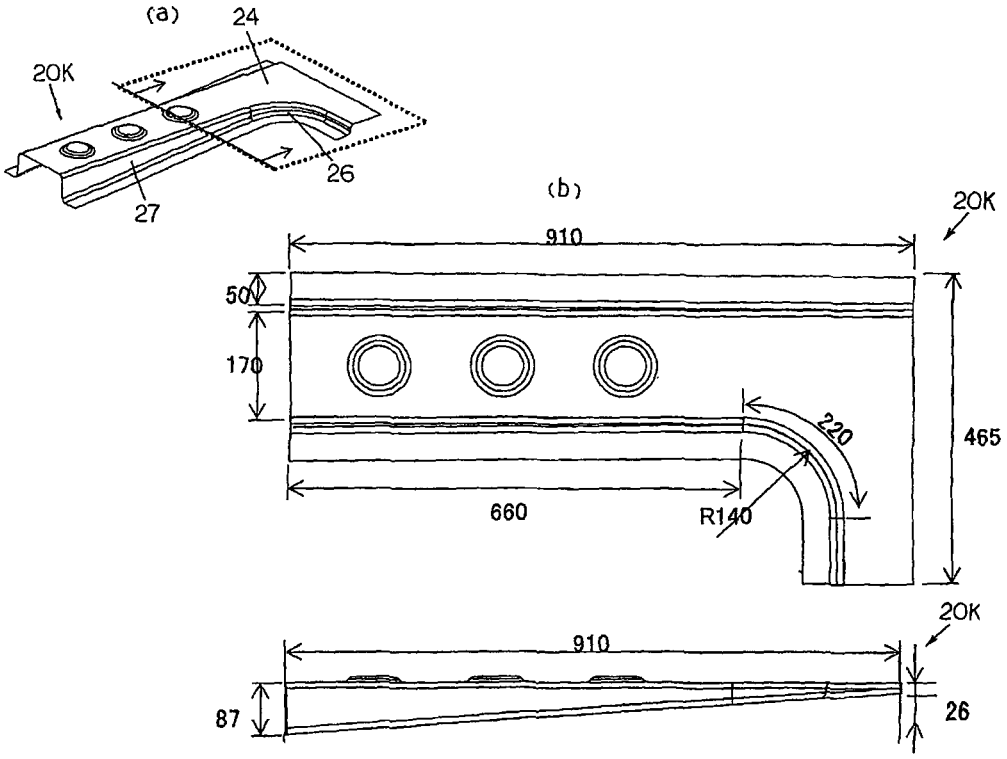

[Fig.20]
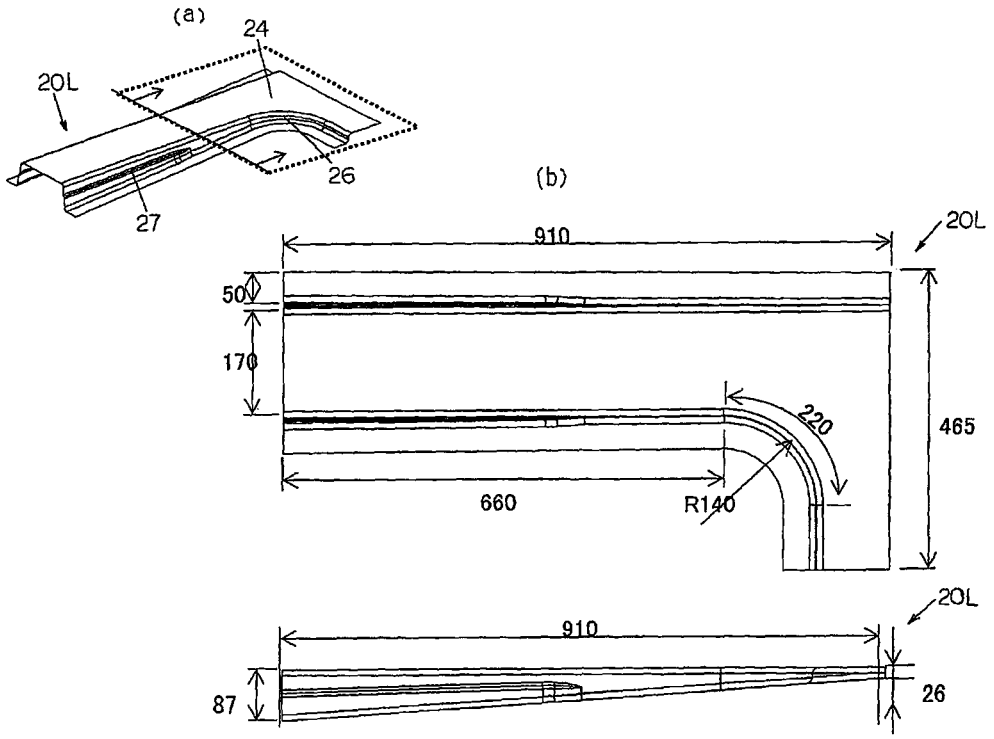

[Fig.21]
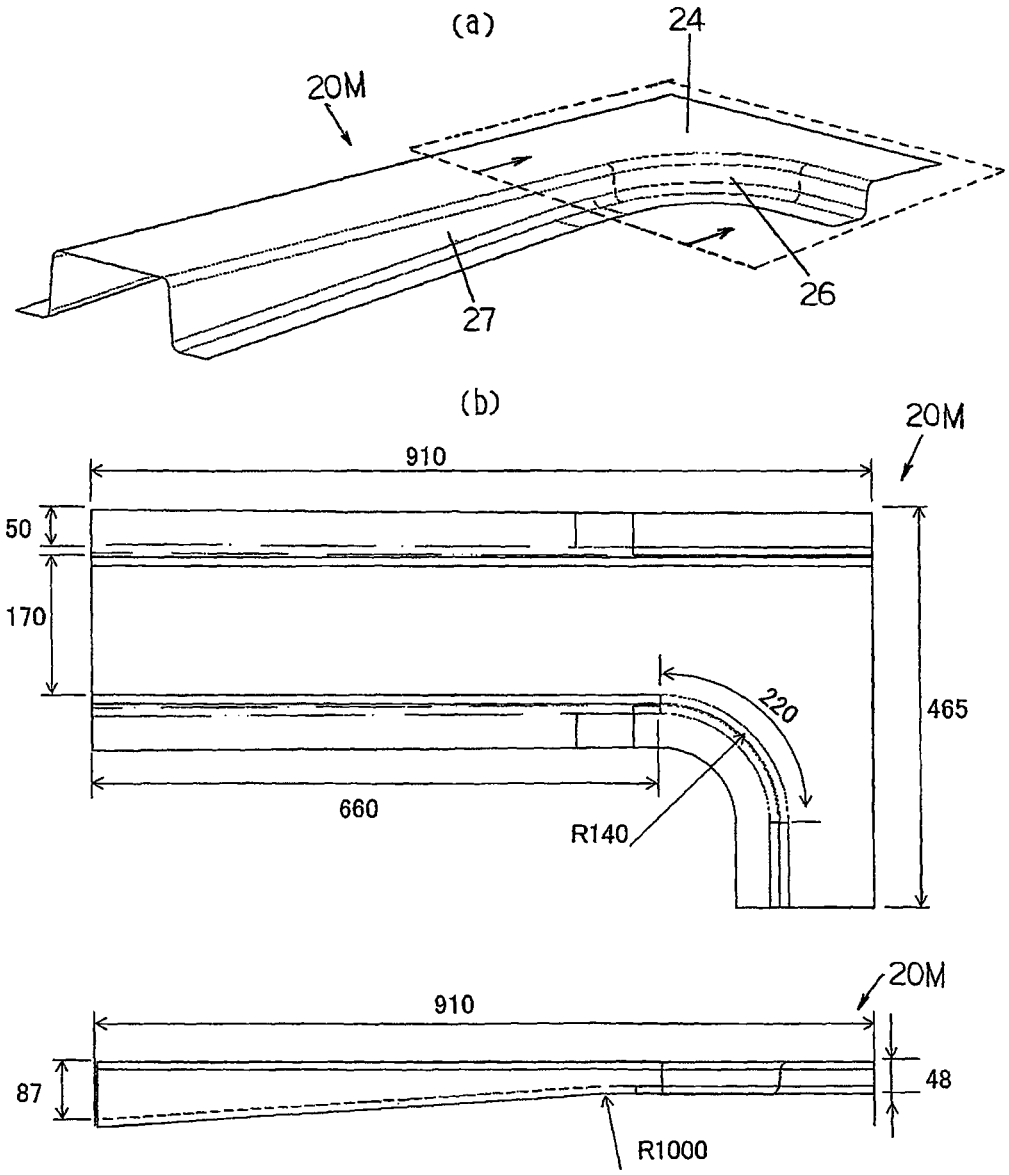

[Fig.22]
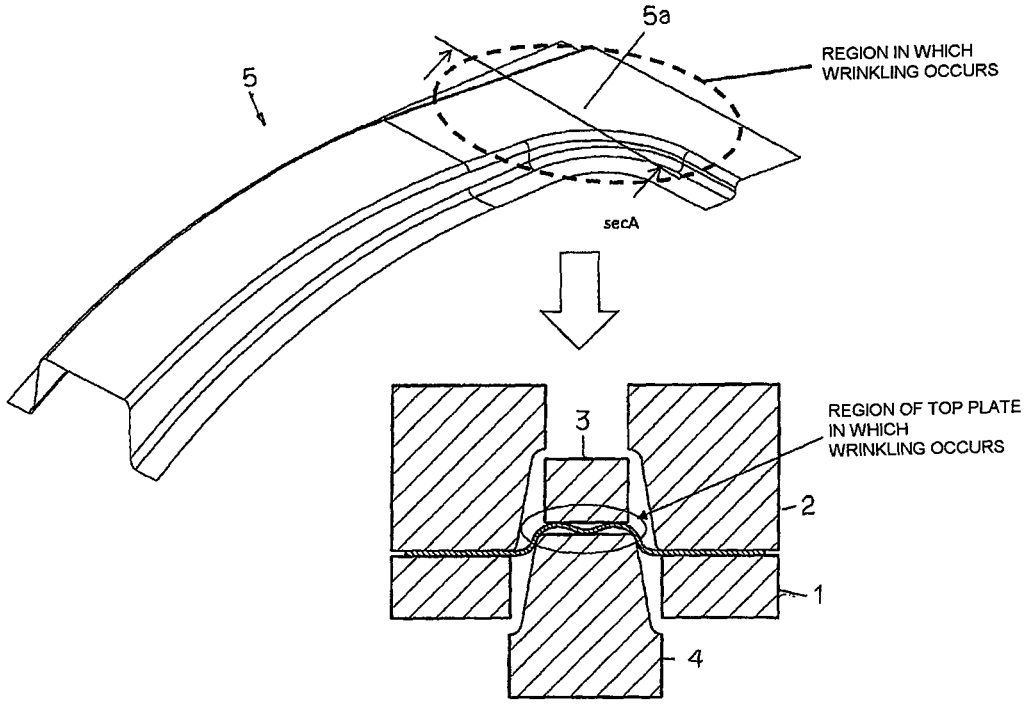
[Fig.23]
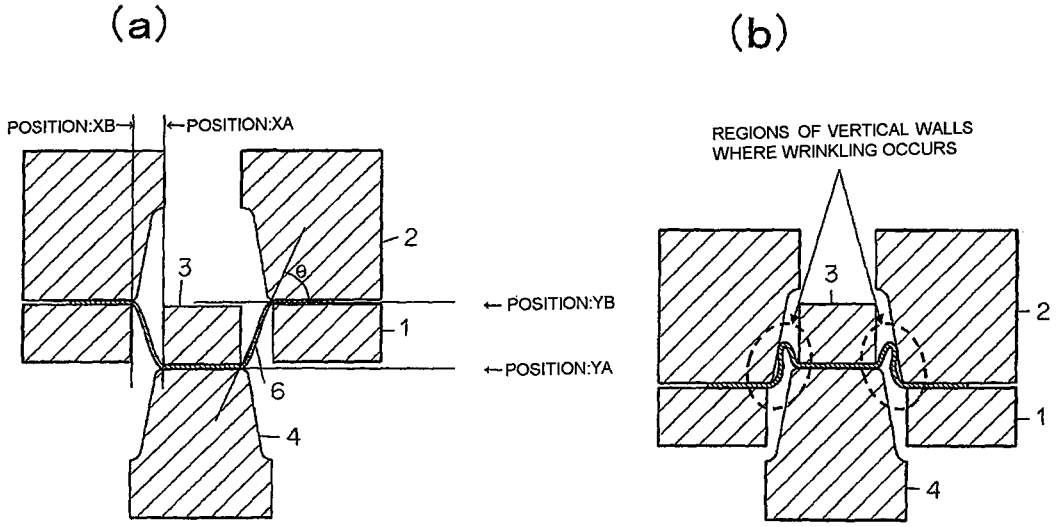

MANUFACTURING METHOD AND MANUFACTURING APPARATUS FOR PRESS-FORMED ARTICLE

TECHNICAL FIELD

The present invention relates to a manufacturing method and a manufacturing apparatus for a press-formed article.

BACKGROUND ART

Of constituent members of an automobile body, known strength members or reinforcing members having a hat-like cross-sectional shape include a front pillar reinforcement, a center pillar reinforcement, a front side member rear, a rear side member, and a cross member, for example.

For example, Patent Document 1 discloses a method of manufacturing a press-formed article for an automobile body that has an excellent collision safety performance. According to the manufacturing method, a metal sheet is bent to form an intermediate formed article having a top plate, a pair of ridges connected to the top plate, and a pair of vertical walls connected to the pair of ridges, respectively.

The intermediate formed article is placed with the top plate protruding toward a punch, and then, press forming is performed by inserting the punch into a die so that the punch presses the top plate, thereby making the top plate protrude in the opposite direction to the direction in which the top plate protrudes before the punch is inserted into the die. According to this manufacturing method, the bent region of the intermediate formed article is bent back in the opposite direction, thereby causing work hardening in the vertical walls of the press-formed article.

The strength members or reinforcing members described above are designed under restrictions that a required strength should be ensured, interference with other parts should be avoided, or a desired space should be ensured. Therefore, to ensure flexibility of the cross-sectional shape, dimensions of such members, such as the height of the vertical walls forming the cross-sectional shape thereof, vary in various ways.

However, the formability of the steel sheet decreases as the strength of the steel sheet increases. If, in view of this, a press-formed article that has vertical walls having a height that varies in the longitudinal direction is manufactured by press-forming a high strength steel sheet in a normal drawing process (using a punch, a die and a blank holder) or a normal pad bending process (using a punch, a die and a pad), a crack or a wrinkling can occur in the press-formed article.

The invention disclosed in Patent Document 1 is directed to a press-formed article that has a hat-shaped cross section and is in a form that is straight in the longitudinal direction and has vertical walls that are not curved in the longitudinal direction, as shown in the paragraph 0031 and FIGS. 1 to 3 of Patent Document 1. Therefore, a press-formed article having vertical walls that are curved in the longitudinal direction cannot be manufactured by the invention disclosed in Patent Document 1.

Therefore, measures have to be taken, such as (a) joining to assemble a plurality of divisional components each press-formed, (b) performing a plurality of press formings (such as performing a shallow draw forming and then a deep draw forming), (c) increasing the thickness of the steel sheet as the strength of the steel sheet decreases or (d) modifying the design of the press-formed article so that the press-formed article can be shaped by the press forming. However, any of such measures leads to an increase of the manufacturing cost of the press-formed article.

Patent Document 2 discloses an invention that involves two press formings to prevent a wrinkling in a flange of a center pillar reinforcement that has vertical walls curved in the longitudinal direction or a wrinkling in the top plate of a press-formed article that has a top plate that varies in width in the longitudinal direction and therefore has an L-shape or T-shape in top view.

According to the invention disclosed in Patent Document 2, in a first press forming, an intermediate formed article without any wrinkling in a flange is formed by forming a curved part by shallow draw forming. Then, in a second press forming, pad bending is performed by holding a top plate of the intermediate formed article with a pad. In this way, a center pillar reinforcement is formed while preventing occurrence of a wrinkling in the top plate.

Patent Document 3 discloses an invention that prevents a wrinkling in a flange of a center pillar reinforcement, which is a press-formed article that is curved in the longitudinal direction, and a wrinkling in a top plate of a press-formed article having an L-shape or T-shape in top view, the top plate of which varies in width in the longitudinal direction, without increasing the number of press formings.

According to the invention disclosed in Patent Document 3, in a first step, a blank is held by a blank holder. In a second step, draw forming is started. In a third step, a top plate starts being held with the pad during the draw forming (when 0 to 50% of the depth is reached). The single press forming consisting of the first to third steps prevents a wrinkling in a flange of a component that is curved in the longitudinal direction and a wrinkling in a top plate of a component, the top plate of which varies in width in the longitudinal direction.

According to the invention disclosed in Patent Document 3, the arrangement of the press tooling is not reversed. That is, press forming is started with the blank holder located above the punch and the upper pad located above the blank holder. During draw forming in which the blank is held between the upper die and the blank holder, the blank is further held between the upper pad and the punch. Patent Document 3 describes that a wrinkling in a flange and a wrinkling in a top plate can be prevented even with the single press forming by performing the press forming as described above.

LIST OF PRIOR ART DOCUMENTS

Patent Document

Patent Document 1: JP5728334
Patent Document 2: WO2014/050973
Patent Document 3: JP2014-240078A

SUMMARY OF INVENTION

Technical Problem

According to the invention disclosed in Patent Document 2, the number of press formings increases, so that the manufacturing cost of the press-formed article increases.

A defective forming that can occur in the invention disclosed in Patent Document 3 assumed in examination by the inventors will be described with reference to FIGS. 22, 23(*a*) and 23(*b*).

FIG. 22 is a diagram for illustrating a region of a top plate in which a wrinkling can occur that is assumed in the invention disclosed in Patent Document 3.

As shown in the A-A cross sectional view of FIG. 22, according to the invention disclosed in Patent Document 3, after a blank is held between a blank holder 1 and an upper die 2, pad holding is performed with a pad 3 and a punch 4. Therefore, when a press-formed article that varies in height of the vertical walls in the longitudinal direction is manufactured, it is assumed that a top plate wrinkling can occur in a top plate 5*a* of a formed article 5 because of a redundant material that occurs during draw forming.

FIGS. 23(*a*) and 23(*b*) are diagrams for illustrating an occurrence state of wrinkling in vertical walls that is assumed in the invention disclosed in Patent Document 3. As shown in FIG. 23(*a*), when the height of the vertical walls of the press-formed article to be manufactured significantly varies in the longitudinal direction (for example, the angle θ is more than 80° in FIG. 23(*a*)), the vertical positional relationship between a height position YA at which a metal sheet 6 is held between the pad 3 and the punch 4 and a height position YB at which the metal sheet 6 is held between the upper die 2 and the blank holder 1 is inevitably reversed at a cross-sectional part (the part will be referred to as a "vertically-reversing part" hereinafter).

If draw forming is then performed, an excessively redundant material occurs between a horizontal position XA at which the metal sheet 6 is held between the pad 3 and the punch 4 arranged in the vertical direction in FIG. 23(*a*) and a horizontal position XB at which the metal sheet 6 is held between the upper die 2 and the blank holder 1. As a result, because of the relationship between the tensile strength of the metal sheet 6 and the force of the upper die 2 and the blank holder 1 holding the metal sheet 6, it is assumed that the metal sheet 6 can buckle, and a wrinkling can occur in the vertical walls as shown in FIG. 23(*b*).

An objective of the present invention is to provide a manufacturing method and a manufacturing apparatus for a press-formed article that can manufacture a press-formed article having a tensile strength of 400 MPa or more mainly used for a strength member or a reinforcing member for an automobile body in one press forming without causing a wrinkling in a top plate or a vertical wall.

A press-formed article to be manufactured according to the present invention extends in a first direction. The press-formed article has a shape defined by a top plate, a ridge connected to the top plate, a vertical wall connected to the ridge, and a flange connected to the vertical wall in a press directional cross section that is along a direction of pressing and intersects the first direction.

In one or both of top view in the direction of pressing and side view in a direction intersecting the direction of pressing, the press-formed article has at least one curved part that is curved in the first direction. The press-formed article has a first part, which includes the curved part, and a second part that is continuous to the first part. A minimum height of the vertical wall in the second part is equal to or more than a maximum height of the vertical wall in the first part.

Solution to Problem

As a result of earnest investigation for solving the problems described above, the inventors have made the present invention based on the findings A and B described below.

(A) A single press forming is divided into steps. More specifically, when the height of the vertical wall of the press-formed article varies in the first direction, the inventors focus on the timing when the metal sheet is held between the pad and the punch and the timing when the metal sheet is held between the die and the blank holder. And the relationship between the height position at which the metal sheet is held between the pad and the punch and the height position at which the metal sheet is held between the die and the blank holder is vertically reversed in at least one press directional cross section in the first direction. In this way, the press-formed article can be manufactured without causing a wrinkling in a flange or a top plate.

(B) That is, in a first step of the single press forming, in at least one formed cross section in the longitudinal direction, a part of the metal sheet to be formed into the top plate of the press-formed article is held between the pad and the punch and a part of the metal sheet to be formed into the flange of the press-formed article is held between the die and the blank holder in such a manner that no wrinkling occurs in the top plate or the flange, thereby completing pad holding.

In the following second step, pad draw forming is performed while the part of the metal sheet to be formed into the top plate is held between the pad and the punch and the part of the metal sheet to be formed into the flange is held between the die and the blank holder in at least one cross section in the first direction.

In this way, unlike the invention disclosed in Patent Document 3, even if the arrangement of the press tooling is vertically reversed along the first direction during the single press forming, the press-formed article can be manufactured without causing a wrinkling in the top plate or the vertical wall.

The present invention provides the followings.

(1) A method of manufacturing a press-formed article, the method using a punch and a blank holder and a pad and a die arranged to be opposed to the punch and the blank holder, and the press-formed article being manufactured by pressing a metal sheet having a tensile strength of 400 MPa or more, which is a steel sheet, an aluminum sheet or an aluminum alloy sheet, disposed between the punch and the blank holder and the pad and the die, wherein the press-formed article extends in a first direction, has a shape defined by a top plate, a ridge connected to the top plate, a vertical wall connected to the ridge and a flange connected to the vertical wall in each of press directional cross sections that are along a direction of pressing and intersect the first direction, has at least one curved part that is curved in the first direction in one or both of top view in the direction of pressing and side view in a direction intersecting the direction of pressing, and has a first part including the curved part and a second part continuous to the first part, a minimum height of the vertical wall in the second part is equal to or more than a maximum height of the vertical wall in the first part, the method comprises a first step in which a pad holding state is established and a second step in which pad draw forming is performed using the punch and the blank holder and the pad and the die after the first step is completed, and in the pad holding state, a part of the metal sheet to be formed into the top plate is held between the pad and the punch, and a part of the metal sheet to be formed into the flange is held between the die and the blank holder, of the press directional cross sections, in a specific press directional cross section of a part of the metal sheet to be formed into the first part, a position of a contacting surface of the blank holder that makes contact with the metal sheet in the direction of pressing is located toward the pad in a direction of arrangement of the pad and the punch, compared with a position of a contacting surface of the pad that makes contact with the metal sheet in the direction of pressing, a vertically-reversing cross-sectional angle, which is an acute angle formed by a straight line that connects a center of a rounded end part of the contacting surface of the pad and a center of a rounded end part of the contacting surface of the blank holder and an extension of the contacting surface of the pad that makes contact with the metal sheet, is more than 0° and equal to or less than 80°, and of the press directional cross sections, in a press directional cross section that is different from the specific press directional cross section, the position of the contacting surface of the pad that makes contact with the metal sheet in the direction of the pressing is located toward the pad in the direction of the arrangement, compared with the position of the contacting surface of the blank holder that makes contact with the metal sheet in the direction of pressing.

(2) The method of manufacturing a press-formed article according to (1), wherein in the first step, in the specific press directional cross section, the blank holder is placed at a height equal to or higher than the minimum height of the vertical wall, and the die is the first to start forming the metal sheet.

(3) The method of manufacturing a press-formed article according to (1) or (2), wherein in a cross section in the direction of pressing of at least a part in the first direction, the pad is the first to start forming the metal sheet.

(4) The method of manufacturing a press-formed article according to any one of (1) to (3), wherein the metal sheet is an intermediate worked article formed from a starting metal sheet by a preforming.

(5) A method of manufacturing a press-formed article, wherein a post-forming is performed on a press-formed article manufactured in the manufacturing method according to any one of (1) to (4).

(6) An apparatus for manufacturing a press-formed article, the apparatus comprising a punch and a blank holder and a pad and a die arranged to be opposed to the punch and the blank holder, and the press-formed article being manufactured by pressing a metal sheet having a tensile strength of 400 MPa or more, which is a steel sheet, an aluminum sheet or an aluminum alloy sheet, disposed between the punch and the blank holder and the pad and the die, wherein the press-formed article extends in a first direction, has a shape defined by a top plate, a ridge connected to the top plate, a vertical wall connected to the ridge and a flange connected to the vertical wall in each of press directional cross sections that are along a direction of pressing and intersect the first direction, has at least one curved part that is curved in the first direction in one or both of top view in the direction of pressing and side view in a direction intersecting the direction of pressing, and has a first part including the curved part and a second part continuous to the first part, a minimum height of the vertical wall in the second part is equal to or more than a maximum height of the vertical wall in the first part, the apparatus manufactures the press-formed article in a first step in which a pad holding state is established and a second step in which pad draw forming is performed using the punch and the blank holder and the pad and the die after the first step is completed, and in the pad holding state, a part of the metal sheet to be formed into the top plate is held between the pad and the punch, and a part of the metal sheet to be formed into the flange is held between the die and the blank holder, of the press directional cross sections, in a specific press directional cross section of a part of the metal sheet to be formed into the first part, a position of a contacting surface of the blank holder that makes contact with the metal sheet in the direction of pressing is located toward the pad in a direction of arrangement of the pad and the punch, compared with a position of a contacting surface of the pad that makes contact with the metal sheet in the direction of pressing, a vertically-reversing cross-sectional angle, which is an acute angle formed by a straight line that connects a center of a rounded end part of the contacting surface of the pad and a center of a rounded end part of the contacting surface of the blank holder and an extension of the contacting surface of the pad that makes contact with the metal sheet, is more than 0° and equal to or less than 80°, and of the press directional cross sections, in a press directional cross section that is different from the specific press directional cross section, the position of the contacting surface of the pad that makes contact with the metal sheet in the direction of the pressing is located toward the pad in the direction of the arrangement, compared with the position of the contacting surface of the blank holder that makes contact with the metal sheet in the direction of pressing.

Advantageous Effects of Invention

According to the present invention, the press-formed article that extends in the first direction (longitudinal direction), has at least the cross-sectional shape described above, has at least one curved part, has the first part and the second part, and has a tensile strength of 400 MPa or more can be manufactured in one press forming without causing a wrinkling in the top plate or a wrinkling in the vertical wall.

BRIEF DESCRIPTION OF DRAWINGS

FIG. 1A is a perspective view showing an example of a configuration of a manufacturing apparatus according to an embodiment.

FIG. 1B is a diagram for illustrating a structure of a vertically-reversing press tooling that is an essential point of the present invention.

FIG. 1C is a perspective view of an example of a press-formed article manufactured by the manufacturing apparatus according to the embodiment.

FIG. 2A is a diagram for illustrating a vertically-reversing cross-sectional angle θ, which is an acute angle formed by a straight line that connects a center of a rounded end part of a contacting surface of a pad and a center of a rounded end part of a contacting surface of a blank holder and an extension of the contacting surface of the pad that makes contact with a blank.

FIG. 2B are diagrams for schematically illustrating a forming process according to the embodiment, and include a side view showing the forming process according to the embodiment and cross-sectional views of sections secA, secB, secC and secD in the side view.

FIG. 2C are diagrams for schematically illustrating the forming process according to the embodiment, and include a side view showing the forming process according to the embodiment and cross-sectional views of sections secA, secB, secC and secD in the side view.

FIG. 2D are diagrams for schematically illustrating the forming process according to the embodiment, and include a side view showing the forming process according to the embodiment and cross-sectional views of sections secA, secB, secC and secD in the side view.

FIG. 2E are diagrams for schematically illustrating the forming process according to the embodiment, and include a side view showing the forming process according to the embodiment and cross-sectional views of sections secA, secB, secC and secD in the side view.

FIG. 3(*a*) is a diagram for illustrating a manufacturing apparatus that has a reverse-forming press tooling that provides a vertically-reversing cross-sectional angle θ of 80° or less, and FIG. 3(*b*) is an enlarged view of a part of the manufacturing apparatus.

FIG. 4(*a*) is a diagram for illustrating a manufacturing apparatus that has a reverse-forming press tooling that provides a vertically-reversing cross-sectional angle θ of 80° or less, and FIG. 4(*b*) is an enlarged view of a part of the manufacturing apparatus.

FIG. 5(*a*) is a diagram for illustrating a manufacturing apparatus that has a reverse-forming press tooling that provides a vertically-reversing cross-sectional angle θ of 80° or less, and FIG. 5(*b*) is an enlarged view of a part of the manufacturing apparatus.

FIG. 6(*a*) is a diagram for illustrating a manufacturing apparatus that has a reverse-forming press tooling that provides a vertically-reversing cross-sectional angle θ of 80° or less, and FIG. 6(*b*) is an enlarged view of a part of the manufacturing apparatus.

FIG. 7(*a*) is a diagram for illustrating a manufacturing apparatus that has a reverse-forming press tooling that provides a vertically-reversing cross-sectional angle θ of 80° or less, and FIG. 7(*b*) is an enlarged view of a part of the manufacturing apparatus.

FIG. 8(*a*) is a diagram for illustrating a manufacturing apparatus that has a reverse-forming press tooling that provides a vertically-reversing cross-sectional angle θ of 80° or less, and FIG. 8(*b*) is an enlarged view of a part of the manufacturing apparatus.

FIG. 9(*a*) is a perspective view showing a shape of a press-formed article 20A manufactured in an example, and FIG. 9(*b*) includes two views (a top view and a side view) of the press-formed article 20A.

FIG. 10(*a*) is a perspective view showing a shape of a press-formed article 20B manufactured in an example, and FIG. 10(*b*) includes two views (a top view and a side view) of the press-formed article 20B.

FIG. 11(*a*) is a perspective view showing a shape of a press-formed article 20C manufactured in an example, and FIG. 11(*b*) includes two views (a top view and a side view) of the press-formed article 20C.

FIG. 12(*a*) is a perspective view showing a shape of a press-formed article 20D manufactured in an example, and FIG. 12(*b*) includes two views (a top view and a side view) of the press-formed article 20D.

FIG. 13(*a*) is a perspective view showing a shape of a press-formed article 20E manufactured in an example, and FIG. 13(*b*) includes two views (a top view and a side view) of the press-formed article 20E.

FIG. 14(*a*) is a perspective view showing a shape of a press-formed article 20F manufactured in an example, and FIG. 14(*b*) includes two views (a top view and a side view) of the press-formed article 20F.

FIG. 15(*a*) is a perspective view showing a shape of a press-formed article 20G manufactured in an example, and FIG. 15(*b*) includes two views (a top view and a side view) of the press-formed article 20G.

FIG. 16(*a*) is a perspective view showing a shape of a press-formed article 20H manufactured in an example, and FIG. 16(*b*) includes two views (a top view and a side view) of the press-formed article 20H.

FIG. 17(*a*) is a perspective view showing a shape of a press-formed article 20I manufactured in an example, and FIG. 17(*b*) includes two views (a top view and a side view) of the press-formed article 20I.

FIG. 18(*a*) is a perspective view showing a shape of a press-formed article 20J manufactured in an example, and FIG. 18(*b*) includes two views (a top view and a side view) of the press-formed article 20J.

FIG. 19(*a*) is a perspective view showing a shape of a press-formed article 20K manufactured in an example, and FIG. 19(*b*) includes two views (a top view and a side view) of the press-formed article 20K.

FIG. 20(*a*) is a perspective view showing a shape of a press-formed article 20L manufactured in an example, and FIG. 20(*b*) includes two views (a top view and a side view) of the press-formed article 20L.

FIG. 21(*a*) is a perspective view showing a shape of a press-formed article 20M manufactured in an example, and FIG. 21(*b*) includes two views (a top view and a side view) of the press-formed article 20M.

FIG. 22 is a diagram for illustrating a region of a top plate in which a wrinkling can occur that is assumed in the invention disclosed in Patent Document 3.

FIGS. 23(*a*) and 23(*b*) are diagrams for illustrating an occurrence state of wrinkling in vertical walls that is assumed in the invention disclosed in Patent Document 3.

DESCRIPTION OF EMBODIMENTS

With reference to the accompanying drawings, an embodiment of the present invention will be described.

1. Configuration of Manufacturing Apparatus 10 according to Embodiment of Present Invention FIG. 1A is a perspective view showing an example of a configuration of a manufacturing apparatus 10. FIG. 1B is a diagram for illustrating a structure of vertically-reversing press tooling of the manufacturing apparatus 10 which is a characteristic of the present invention and shows a cross section and a structure of the press tooling in a pad holding state in this embodiment and a blank 15. FIG. 1C is a perspective view showing an example of a press-formed article 20 manufactured by the manufacturing apparatus 10.

As shown in FIGS. 1A and 1B, the manufacturing apparatus 10 includes a punch 11 and a blank holder 12, and a pad 13 and a die 14. The pad 13 and the die 14 are arranged to be opposed to the punch 11 and the blank holder 12.

Any or all of the punch 11, the blank holder 12, the pad 13 and the die 14 may be divided into a plurality of components in a first direction described later. In that case, the divided components of the punch 11, the blank holder 12, the pad 13 or the die 14 may be integrally operated in synchronization with each other or may not be synchronized with each other and operated so as to relatively move with respect to each other.

The manufacturing apparatus 10 manufactures the press-formed article 20 by pressing a metal sheet (referred to as a blank hereinafter) 15 disposed between the punch 11 and blank holder 12 and the pad 13 and die 14.

The blank 15 may be subjected to a preforming, such as stamping, draw forming, bending, die cutting, trimming or punching, at a seating face, a bead, a ridge, a hole, a notch or the like thereof. Furthermore, the press-formed article 20 may be subjected to a post-working, such as restriking, trimming or piercing. Of course, the types of preforming and post-working are not limited to those described above.

Although not particularly limited, the blank 15 is desirably made of a high-strength material, and is a steel sheet, an aluminum sheet or an aluminum alloy sheet having a tensile strength of 400 to 2000 MPa. The tensile strength of the blank 15 that is a steel sheet is desirably 440 MPa or more, more desirably 590 MPa or more, still more desirably 780 MPa or more, even more desirably 980 MPa or more, and most desirably 1180 MPa or more.

2. Press-Formed Article 20 Manufactured in this Embodiment

The press-formed article 20 extends in the first direction (which is the direction indicated by double-headed arrows in FIG. 1C and the longitudinal direction of the press-formed article 20). The press-formed article 20 has a cross-sectional shape defined by at least a top plate 21, two ridges 22, two vertical walls 23 and two flanges 25 (a hat-like cross-sectional shape in the press-formed article 20) over the entire dimension in the longitudinal direction. The two ridges 22 are connected to the top plate 21. The two vertical walls 23 are connected to the two ridges 22, respectively. The two flanges 25 are connected to the two vertical walls 23, respectively. The press-formed article 20 may have a cross-sectional shape defined by at least the top plate 21, one ridge 22, one vertical wall 23 and one flange 25.

A height h (the dimension in the direction of pressing) of the vertical wall 23 of the press-formed article 20 varies in the first direction. If the maximum value of the variation in height h of the vertical wall 23 is less than 5 mm, the press-formed article 20 can be formed without the present invention. On the other hand, if the maximum value of the variation in height h of the vertical wall 23 is more than 150 mm, a wrinkling or a crack can occur in the top plate 21, the vertical wall 23 or the flange 25 even if the present invention is applied. For this reason, the maximum value of the variation in height h of the vertical wall 23 is desirably 5 to 150 mm.

If a value of the ratio of the maximum value of the variation in height h of the vertical wall 23 to the overall length of the press-formed article 20 in the longitudinal direction (the dimension projected in the direction of pressing) ((the maximum value of the variation in height h)/(the overall length)) is less than 0.005, the press-formed article 20 can be formed without the present invention. On the other hand, if the value of the ratio is more than 0.200, a wrinkling or a crack can occur in the top plate 21, the vertical wall 23 or the flange 25 even if the present invention is applied. For this reason, the value of the ratio is desirably 0.005 to 0.200.

The press-formed article 20 has at least one curved part 24. The curved part 24 is curved in the first direction, in side view taken in the direction intersecting the vertical wall 23 (a view taken in the direction of the arrow B). If the minimum value of a radius of curvature R of the curved part 24 is less than 30 mm, a wrinkling or a crack can occur in the top plate 21, the vertical wall 23 or the flange 25 even if the present invention is applied. On the other hand, if the minimum value of the radius of curvature R is more than 5000 mm, the press-formed article 20 can be formed without the present invention. For this reason, the minimum value of the radius of curvature R of the curved part 24 is desirably 30 to 5000 mm.

In addition to the curved part 24, or instead of the curved part 24, the press-formed article 20 may have at least one curved part that is curved in the longitudinal direction in top view taken in the direction intersecting the top plate 21 (a view taken in the direction of the arrow A).

The press-formed article 20 has a first part 26 and two second parts 27. The first part 26 and the second parts 27 are arranged side by side in the first direction with the first part 26 interposed between the two second parts 27. The first part 26 includes the curved part 24. Both the minimum heights of the vertical walls 23 of the two second parts 27 are equal to or more than the maximum height of the vertical walls 23 of the first part 26.

There may be two or more curved parts 24, which may be spaced apart from each other in the first direction or adjacent to each other in the first direction.

The press-formed article 20 desirably has the dimension listed below.

Sheet Thickness: 0.4 to 6.0 mm

Width of Top Plate 21: 30 to 2000 mm

Height of Vertical Wall 23: 20 to 500 mm

Width of Flange 25: 10 to 100 mm

Maximum Value of Variation in Height of Vertical wall 23 in First Direction: 5 to 150 mm Minimum Value of Radius of Curvature R of Curved Part 24: 30 to 5000 mm Although the press-formed article 20 has a high tensile strength of 400 MPa or more as described above, the press-formed article 20 has a complicated shape: the height of the vertical walls 23 varies in the first direction, and the press-formed article 20 has at least one curved part 24. This ensures a sufficient flexibility of the cross-sectional shape of the press-formed article 20.

Therefore, the press-formed article 20 is highly suitable for a strength member or reinforcing member having a hat-like cross-sectional shape (such as a front pillar reinforcement, a center pillar reinforcement, a front side member rear, a rear side member, or a cross member) of constituent members of an automobile body.

3. Detailed Configuration of Manufacturing Apparatus 10

The pad 13 and the punch 11 serve to hold a part of the blank 15 that is to be formed into the top plate 21 of the press-formed article 20. The die 14 and the blank holder 12 serve to hold a part of the blank 15 that is to be formed into the flange 25 of the press-formed article 20. Furthermore, the punch 11 and blank holder 12 and the pad 13 and die 14 serve to perform pad draw forming of the blank 15 after pad holding is completed.

FIG. 2A is a diagram for illustrating a vertically-reversing cross-sectional angle θ, which is an acute angle formed by a straight line m, which connects a center 13*b* of a rounded end part of a contacting surface 13*a* of the pad 13 that makes contact with the blank 15 and a center 12*b* of a rounded end part of a contacting surface 12*a* of the blank holder 12 that makes contact with the blank 15, and an extension n of the contacting surface 13*a* of the pad 13 that makes contact with the blank 15.

As shown in FIG. 2A, of cross sections along the direction of pressing (press directional cross sections), in a specific cross section along the direction of pressing (specific press directional cross section) of a part of the blank 15 to be formed into the first part 26, the pad 13 and punch 11 and the die 14 and blank holder 12 are arranged in such a manner that the position of the contacting surface of the blank holder 12 that makes contact with the blank 15 in the direction of pressing is located toward the pad 13 in the direction of arrangement of the pad 13 and the punch 11, compared with the position of the contacting surface of the pad 13 that makes contact with the blank 15 in the direction of pressing.

Furthermore, as shown in FIG. 2A, the pad 13 and punch 11 and the die 14 and blank holder 12 complete the pad holding with a vertically-reversing cross-sectional angle θ falling within a range $0° < \theta \leq 80°$.

After the pad holding is completed, the pad 13 and punch 11 and the die 14 and blank holder 12 serve to perform pad draw forming.

The vertically-reversing cross-sectional angle θ is more than 0° and equal to or less than 80°. If the vertically-reversing cross-sectional angle θ is more than 80°, when the pad 13 and punch 11 and the die 14 and blank holder 12 move during forming and the positional relationship therebetween is reversed, the blank 15 interferes therewith and buckles, and a wrinkling occurs in the vertical wall 23 of the press-formed article 20, so that the press-formed article cannot be formed. On the other hand, if the vertically-reversing cross-sectional angle θ is equal to or less than 0°, the forming is the normal draw forming. For this reason, according to the present invention, the vertically-reversing cross-sectional angle θ is more than 0° and equal to or less than 80°.

A limit value of the vertically-reversing cross-sectional angle θ increases as the tensile strength of the blank 15 increases. The value of the vertically-reversing cross-sectional angle θ is desirably equal to or less than 70° when the tensile strength of the blank 15 is equal to or more than 980 MPa, and is desirably equal to or less than 60° when the tensile strength of the blank 15 is less than 980 MPa.

As shown in FIG. 2A, a step of completing holding of the blank 15 between the pad 13 and the punch 11 and holding of the blank 15 between the die 14 and the blank holder 12 is referred to as a "pad holding completion step".

With the manufacturing apparatus 10 and the manufacturing method, in the pad holding completion step, the cross-sectional shape of the press tooling is changed in a formed cross section of at least one part in the longitudinal direction where the vertically-reversing cross-sectional angle θ is more than 0° and equal to or less than 80°. As a result, the press-formed article 20 can be formed without causing a wrinkling in the top plate 21, the vertical walls 22 and the flanges 24.

FIGS. 2B to 2E are diagrams for schematically illustrating a forming process according to this embodiment, and each include a side view showing the forming process according to this embodiment and cross-sectional views of sections secA, secB, secC and secD in the side view. FIGS. 2B to 2E show a forming surface of the press tooling, and hatched parts represent vertical wall parts of the die 14 and the punch 11. A reason why the pad 13 and the blank holder 12 are represented by a line in FIGS. 2B to 2E is that the pad 13 and the blank holder 12 are flat in each cross section in this example.

As shown by the section secD in FIG. 2D, of the press directional cross sections, in the specific press directional cross section of the part of the blank 15 to be formed into the first part 26, the position of the contacting surface of the blank holder 12 that makes contact with the blank 15 in the direction of pressing is located toward the pad 13 in the direction of arrangement of the pad 13 and the punch 12, compared with the position of the contacting surface of the pad 13 that makes contact with the blank 15 in the direction of pressing.

In the following, the forming process of the press-formed article 20 according to this embodiment will be schematically described on a time-series basis.

FIGS. 2B to 2D show a first step of the manufacturing method according to this embodiment, and FIG. 2E shows a second step of the manufacturing method according to this embodiment.

FIG. 2B shows an initial phase before forming is started (the arrangement of the punch 11, the blank holder 12, the pad 13 and the die 14 at a top dead center of forming), FIG. 2C shows a phase in which holding of the blank 15 between the pad 13 and the punch 11 is completed (the arrangement of the punch 11, the blank holder 12, the pad 13 and the die 14 in a pad completion state position), FIG. 2D shows a phase in which pad holding is completed (the arrangement of the punch 11, the blank holder 12, the pad 13 and the die 14 in the pad holding position), and FIG. 2E shows an end phase after a bottom dead center of forming is reached and forming is completed (the arrangement of the punch 11, the blank holder 12, the pad 13 and the die 14 at a bottom dead center of forming).

In the initial phase before forming is started (at the top dead center of forming) shown in FIG. 2B, the pad 13 is in contact with an upper surface of the blank 15 at the section secC. At the sections secA, secB and secD, any of the punch 11, the blank holder 12, the pad 13 and the die 14 is not in contact with the blank 15.

In the phase in which holding of the blank 15 between the pad 13 and the punch 11 is completed shown in FIG. 2C (in the pad completion state position), the pad 13 presses the blank 15 down at the sections secA to secC, and in particular, the blank 15 is held between the pad 13 and the punch 11 in the sections secB and secC.

Therefore, a wrinkling is prevented from occurring in the part of the blank 15 to be formed into the top plate 21. At the section secD, although the blank 15 is held between the pad 13 and the punch 11, the blank 15 is not deformed.

In order to sufficiently prevent a crack or a wrinkling from occurring during forming, it is desirable to (a) place the blank holder 12 at a height equal to or more than the minimum height of the vertical walls 23 of the press-formed article 20 so that the die 14 is the first to start forming the blank 15 or (b) make the pad 13 be the first to start forming the blank 15 in the formed cross section of at least one part in the longitudinal direction.

In the phase in which pad holding is completed (in the pad holding position) shown in FIG. 2D, at the section secB, the part of the blank 15 to be formed into the top plate 21 is held between the pad 13 and the punch 11, and the parts of the blank 15 to be formed into the flanges 25 are held between the die 14 and the blank holder 12.

That is, when pad holding is completed, the blank 15 is held between the die 14 and the blank holder 12 at the sections secA, secB and secD, and held between the punch 11 and the pad 13 at the sections secB to secD.

At the section secA, the pad 13 is arranged at an upper position, so that the vertically-reversing cross-sectional angle θ is more than 0° and equal to or less than 80°. At the section secC, the blank holder 12 is arranged at a lower position, so that the vertically-reversing cross-sectional angle θ is more than 0° and equal to or less than 80°.

The blank 15 is a high strength material having a tensile strength of 400 to 2000 MPa. Therefore, at the section secB, when the die 14 moves down in the second step described later, the force applied on the parts of the blank 15 to be formed into the flanges 25 in the in-plane direction is higher than the pressing force of the die 14 and the blank holder 12, so that the blank 15 does not buckle in this section but slides between the die 14 and the blank holder 12, the parts of the blank 15 to be formed into the flanges 25 are pushed out of the press tooling.

Therefore, the blank 15 has no redundant part between the pad 13 and the blank holder 12, so that a wrinkling is prevented from occurring in the vertical walls.

That is, the present invention takes advantage of the high tensile strength of the blank 15 to prevent occurrence of a winkling in the vertical walls.

In the end phase after forming is completed (at the bottom dead center of forming) shown in FIG. 2E, after pad holding is completed, pad draw forming is performed by the punch 11 and blank holder 12 and the pad 13 and die 14, thereby manufacturing the press-formed article 20.

In the actual forming of the press article 20, in a cross section of at least one part in the longitudinal direction, there may be a part that is not held between the pad 13 and the punch 11 or between the die 14 and the blank holder 12.

4. Means for Achieving Vertically-Reversing cross-sectional angle θ more than 0° and equal to or less than 80°

FIG. 3(*a*) is a diagram for illustrating a manufacturing apparatus 10-1 that has a reverse-forming press tooling that provides a vertically-reversing cross-sectional angle θ of 80° or less, and FIG. 3(*b*) is an enlarged view of a part of the manufacturing apparatus 10-1. The manufacturing apparatus 10-1 has a pad 13 having a smaller width w and thereby achieves a vertically-reversing cross-sectional angle θ more than 0° and equal to or less than 80°.

FIG. 4(*a*) is a diagram for illustrating a manufacturing apparatus 10-2 that has a reverse-forming press tooling that provides a vertically-reversing cross-sectional angle θ of 80° or less, and FIG. 4(*b*) is an enlarged view of a part of the manufacturing apparatus 10-2. The manufacturing apparatus 10-2 has a blank holder 12 having a smaller width so that the blank holder 12 is further spaced apart from a rounded die corner part 14*a* of the die 14 and thereby achieves a vertically-reversing cross-sectional angle θ more than 0° and equal to or less than 80°.

FIG. 5(*a*) is a diagram for illustrating a manufacturing apparatus 10-3 that has a reverse-forming press tooling that provides a vertically-reversing cross-sectional angle θ of 80° or less, and FIG. 5(*b*) is an enlarged view of a part of the manufacturing apparatus 10-3. The manufacturing apparatus 10-3 has a pad 13 located at a higher level and thereby achieves a vertically-reversing cross-sectional angle θ more than 0° and equal to or less than 80°.

Furthermore, FIG. 6(*a*) is a diagram for illustrating a manufacturing apparatus 10-4 that has a reverse-forming press tooling that provides a vertically-reversing cross-sectional angle θ of 80° or less, and FIG. 6(*b*) is an enlarged view of a part of the manufacturing apparatus 10-4. The manufacturing apparatus 10-4 has a blank holder 12 located at a lower level and thereby achieves a vertically-reversing cross-sectional angle θ more than 0° and equal to or less than 80°.

The means shown in FIGS. 3 to 6 can achieve a vertically-reversing cross-sectional angle θ more than 0° and equal to or less than 80°.

FIG. 7(*a*) is a diagram for illustrating a manufacturing apparatus 10-5 that has a reverse-forming press tooling that provides a vertically-reversing cross-sectional angle of 80° or less, and FIG. 7(*b*) is an enlarged view of a part of the manufacturing apparatus 10-5.

The manufacturing apparatus 10-5 has a punch 11 that has a rounded punch corner part 11*a* having a larger radius of curvature and thereby achieves a vertically-reversing cross-sectional angle θ more than 0° and equal to or less than 80°. The pad 13 may have a larger width w as far as the vertically-reversing cross-sectional angle θ can be maintained to be 80° or less.

FIG. 8(*a*) is a diagram for illustrating a manufacturing apparatus 10-6 that has a reverse-forming press tooling that provides a vertically-reversing cross-sectional angle of 80° or less, and FIG. 8(*b*) is an enlarged view of a part of the manufacturing apparatus 10-6. The manufacturing apparatus 10-6 has a die 14 that has a rounded die corner part 14*a* having a larger radius of curvature and thereby achieves a vertically-reversing cross-sectional angle θ more than 0° and equal to or less than 80°. The width of the blank holder 12 may be increased so that the blank holder 12 comes closer to the rounded die corner part 14*a* as far as the vertically-reversing cross-sectional angle θ can be maintained to be 80° or less.

5. Manufacturing Method According to this Embodiment

According to the manufacturing method according to this embodiment, the press-formed article 20 is manufactured by pressing the blank 15 with the punch 11 and blank holder 12 and the pad 13 and die 14. The manufacturing method includes the first step in which the pad holding state is established, and the second step in which pad draw forming is performed with the punch 11 and blank holder 12 and the pad 13 and die 14 after the first step is completed.

First Step: while the part of the blank 15 to be formed into the top plate 21 is held between the pad 13 and the punch 11, and the parts of the blank 15 to be formed into the flanges 25 are held between the die 14 and the blank holder 12, the pad holding state is established by satisfying the conditions 1 to 3 specified below.

(Condition 1) Of the press directional cross sections, in the specific press directional cross section of a part of the blank 15 to be formed into the first part 26, the position of the contacting surface of the blank holder 12 that makes contact with the blank 15 in the direction of pressing is located toward the pad 13 in the direction of arrangement of the pad 13 and the punch 11, compared with the position of the contacting surface of the pad 13 that makes contact with the blank 15 in the direction of pressing.

(Condition 2) The vertically-reversing cross-sectional angle θ is set to be more than 0° and equal to or less than 80° by the means for achieving a vertically-reversing cross-sectional angle θ more than 0° and equal to or less than 80° shown in FIGS. 3(*a*) and 3(*b*), FIGS. 4(*a*) and 4(*b*), FIGS. 5(*a*) and 5(*b*), FIGS. 6(*a*) and 6(*b*), FIGS. 7(*a*) and 7(*b*) or FIGS. 8(*a*) and 8(*b*), or a combination thereof, for example.

(Condition 3) Of the press directional cross sections, in a press directional cross section that is different from the specific press directional cross section, the position of the contacting surface of the pad 13 that makes contact with the blank 15 in the direction of pressing is located toward the pad 13 in the direction of arrangement of the pad 13 and the punch 11, compared with the position of the contacting surface of the blank holder 12 that makes contact with the blank 15 in the direction of pressing.

Second Step: after the pad holding state is established in the first step, the press-formed article 20 is completed by performing pad draw forming with the punch 11 and blank holder 12 and the pad 13 and die 14.

The press-formed article 20 manufactured in the first and second steps may be further subjected to a post-working.

As described above, according to this embodiment, the press-formed article 20 can be manufactured in one press forming without causing a wrinkling in the top plate or the vertical walls. In addition, according to this embodiment, reverse forming is performed to make the material redundant, so that occurrence of a crack can be reduced.

When the height h of the vertical walls 23 of the press-formed article 20 varies significantly, the profiles of the die face of the die 14 and the pad face of the pad 13 need to be aligned with each other in side view. However, the reverse forming according to this embodiment does not require an adjustment, which is necessary in performing the conventional step drawing, of level between the die face and the pad face, so that the material yield can be improved.

EXAMPLE

FIGS. 9(*a*) to 21(*a*) are perspective views showing shapes of press-formed articles 20A to 20M manufactured in examples, and FIGS. 9(*b*) to 21(*b*) include two views (a top view and a side view) of the press-formed articles 20A to 20M. In FIGS. 9(*b*) to 21(*b*), the dimensions are given in mm. In FIGS. 9(*a*) to 21(*a*), the range denoted by the dashed line represents a vertically-reversing forming range.

Press-formed articles 20A to 20M in inventive examples 1 to 17 and comparative examples 1 to 4 having shapes described in TABLE 1 were manufactured by press-forming a starting metal sheet having properties (type, sheet thickness and tensile strength of the starting metal sheet) shown in TABLE 1 with a press tooling unit that has a pad, a punch, a blank holder and an upper die.

A press-formed article 20A in an inventive example 1 and a comparative example 3 shown in FIG. 9 has a concave curved part 24 that is curved on one side in top view. In the inventive example 1, the reverse-forming press tooling shown in FIG. 4 was used to achieve a vertically-reversing cross-sectional angle θ more than 0° and equal to or less than 80°.

A press-formed article 20B in an inventive example 2 and a comparative example 4 shown in FIG. 10 has a curved part 24 that is convex in top view and is straight in side view. In the inventive example 2, the reverse-forming press tooling shown in FIG. 3 was used to achieve a vertically-reversing cross-sectional angle θ more than 00 and equal to or less than 80°.

A press-formed article 20C in an inventive example 3 shown in FIG. 11 has a curved part 24 that is straight in top view and is convex in side view. In the inventive example 3, the reverse-forming press tooling shown in FIG. 5 was used to achieve a vertically-reversing cross-sectional angle θ more than 0° and equal to or less than 80°.

A press-formed article 20D in an inventive example 4 shown in FIG. 12 has a curved part 24 that is straight in top view and is concave in side view. In the inventive example 4, the reverse-forming press tooling shown in FIG. 6 was used to achieve a vertically-reversing cross-sectional angle θ more than 0° and equal to or less than 80°.

A press-formed article 20E in inventive examples 5 and 9 to 14 shown in FIG. 13 has a curved part 24 that is concave in top view and is straight in side view.

In the inventive examples 5 and 9 to 14, the reverse-forming press tooling shown in FIG. 4 was used to achieve a vertically-reversing cross-sectional angle θ more than 0° and equal to or less than 80°.

A press-formed article 20F in an inventive example 6 shown in FIG. 14 has a curved part 24 that is straight in top view and is convex in side view. In the inventive example 6, the reverse-forming press tooling shown in FIG. 5 was used to achieve a vertically-reversing cross-sectional angle θ more than 0° and equal to or less than 80°.

A press-formed article 20G in an inventive example 7 shown in FIG. 15 has a curved part 24 that is straight in top view and is concave in side view. In the inventive example 7, the reverse-forming press tooling shown in FIG. 6 was used to achieve a vertically-reversing cross-sectional angle θ more than 0° and equal to or less than 80°.

A press-formed article 20H having a T-shape in an inventive example 8 shown in FIG. 16 has a curved part 24 that is concave in top view and is straight in side view.

In the inventive example 8, the reverse-forming press tooling shown in FIG. 4 was used to achieve a vertically-reversing cross-sectional angle θ more than 0° and equal to or less than 80°.

A press-formed article 20I in a comparative example 1 shown in FIG. 17 has a curved part 24 that is concave on one side in top view. Although the reverse-forming press tooling shown in FIG. 4 was used, a vertically-reversing cross-sectional angle θ more than 0° and equal to or less than 80° was not able to be achieved.

A press-formed article 20J in a comparative example 2 shown in FIG. 18 has a curved part 24 that is convex in top view and is straight in side view. Although the reverse-forming press tooling shown in FIG. 3 was used, a vertically-reversing cross-sectional angle θ more than 0° and equal to or less than 80° was not able to be achieved.

A press-formed article 20K in an inventive example 15 shown in FIG. 19 has a curved part 24 that is concave in top view and is straight in side view and is subjected to a preforming in which seating faces are formed on the part of the blank to be formed into the top plate 21. In the inventive example 15, the reverse-forming press tooling shown in FIG. 4 was used to achieve a vertically-reversing cross-sectional angle θ more than 0° and equal to or less than 80°.

A press-formed article 20L in an inventive example 16 shown in FIG. 20 has a curved part 24 that is concave in top view and is straight in side view and is subjected to restriking as a post-working. In the inventive example 16, the reverse-forming press tooling shown in FIG. 4 was used to achieve a vertically-reversing cross-sectional angle θ more than 0° and equal to or less than 80°.

Furthermore, a press-formed article 20M in an inventive example 17 shown in FIG. 21 has a curved part 24 that is concave in top view and is straight in side view. In the inventive example 17, the reverse-forming press tooling shown in FIG. 4 was used to achieve a vertically-reversing cross-sectional angle θ more than 0° and equal to or less than 80°.

As geometrical characteristics of the press-formed articles in the inventive examples 1 to 17 and the comparative examples 1 to 4, TABLE 1 shows the overall length in the longitudinal direction, the maximum value of the height of the vertical walls, the minimum value of the height of the vertical walls, the variation in height of the vertical walls, the minimum value of the width of the top plate, the maximum width of the press-formed article, the shape in top view, the shape in side view and the radius of curvature of the curved part. As manufacturing conditions, TABLE 1 shows the vertically-reversing cross-sectional angle θ, the reverse-forming press tooling (the number of the drawing showing the press tooling used), and the presence or absence of a preforming or a post-working. As assessments after forming, TABLE 1 shows an assessment of the presence or absence of a wrinkling in the flange part, the top plate part and the vertical wall part and an assessment of the presence or absence of a crack in the flange part, the top plate part and the vertical wall part. The underlines shown in TABLE 1 mean that the relevant example is not included in the present invention or the assessment result is poor.

TABLE 1

| EXAMPLE | PRESS-FORMED ARTICLE | PROPERTIES: TYPE OF STARTING METAL SHEET | PROPERTIES: SHEET THICKNESS mm | PROPERTIES: TENSILE STRENGTH MPa | GEOMETRICAL CHARACTERISTICS OF PRESS-FORMED ARTICLE: OVERALL LENGTH IN LONGITUDINAL DIRECTION mm | GEOMETRICAL CHARACTERISTICS OF PRESS-FORMED ARTICLE: MAXIMUM VALUE OF HEIGHT OF VERTICAL WALLS mm | GEOMETRICAL CHARACTERISTICS OF PRESS-FORMED ARTICLE: MINIMUM VALUE OF HEIGHT OF VERTICAL WALLS mm | GEOMETRICAL CHARACTERISTICS OF PRESS-FORMED ARTICLE: VARIATION IN HEIGHT OF VERTICAL WALLS mm |
|---|---|---|---|---|---|---|---|---|
| INVENTIVE EXAMPLE 1 | 20A | STEEL SHEET | 1 | 980 | 910 | 87 | 26 | 61 |
| INVENTIVE EXAMPLE 2 | 20B | STEEL SHEET | 1 | 980 | 910 | 87 | 26 | 61 |
| INVENTIVE EXAMPLE 3 | 20C | STEEL SHEET | 1 | 980 | 910 | 95 | 25 | 70 |
| INVENTIVE EXAMPLE 4 | 20D | STEEL SHEET | 1 | 980 | 910 | 95 | 25 | 70 |
| COMPARATIVE EXAMPLE 1 | 20I | STEEL SHEET | 1 | 980 | 910 | 216 | 26 | 190 |
| COMPARATIVE EXAMPLE 2 | 20J | STEEL SHEET | 1 | 980 | 910 | 216 | 26 | 190 |
| COMPARATIVE EXAMPLE 3 | 20A | STEEL SHEET | 1 | 980 | 910 | 87 | 26 | 61 |
| COMPARATIVE EXAMPLE 4 | 20B | STEEL SHEET | 1 | 980 | 910 | 87 | 26 | 61 |
| INVENTIVE EXAMPLE 5 | 20E | STEEL SHEET | 1 | 980 | 910 | 87 | 26 | 61 |
| INVENTIVE EXAMPLE 6 | 20F | STEEL SHEET | 1 | 980 | 910 | 95 | 25 | 70 |
| INVENTIVE EXAMPLE 7 | 20G | STEEL SHEET | 1 | 980 | 910 | 95 | 25 | 70 |
| INVENTIVE EXAMPLE 8 | 20H | STEEL SHEET | 1 | 980 | 910 | 87 | 26 | 61 |
| INVENTIVE EXAMPLE 9 | 20E | STEEL SHEET | 1 | 440 | 910 | 87 | 26 | 61 |
| INVENTIVE EXAMPLE 10 | 20E | STEEL SHEET | 1 | 590 | 910 | 87 | 26 | 61 |
| INVENTIVE EXAMPLE 11 | 20E | STEEL SHEET | 1 | 780 | 910 | 87 | 26 | 61 |
| INVENTIVE EXAMPLE 12 | 20E | STEEL SHEET | 1 | 1180 | 910 | 87 | 26 | 61 |
| INVENTIVE EXAMPLE 13 | 20E | STEEL SHEET | 1 | 1470 | 910 | 87 | 26 | 61 |
| INVENTIVE EXAMPLE 14 | 20E | ALUMINUM SHEET | 1 | 400 | 910 | 87 | 26 | 61 |
| INVENTIVE EXAMPLE 15 | 20K | STEEL SHEET | 1 | 980 | 910 | 87 | 26 | 61 |
| INVENTIVE EXAMPLE 16 | 20L | STEEL SHEET | 1 | 980 | 910 | 87 | 26 | 61 |
| INVENTIVE EXAMPLE 17 | 20M | STEEL SHEET | 1 | 980 | 910 | 87 | 48 | 39 |

| EXAMPLE | GEOMETRICAL CHARACTERISTICS OF PRESS-FORMED ARTICLE: VARIATION IN HEIGHT OF VERTICAL WALLS/OVERALL LENGTH | MINIMUM VALUE OF WIDTH OF TOP PLATE mm | MAXIMUM VALUE OF WIDTH OF PRESS-FORMED ARTICLE mm | SHAPE IN TOP VIEW: NUMBER OF CONCAVE CURVED PARTS (A) | SHAPE IN TOP VIEW: NUMBER OF CONVEX CURVED PARTS (B) | SHAPE IN SIDE VIEW: NUMBER OF CONVEX CURVED PARTS PROTRUDING UPWARD (C) | SHAPE IN SIDE VIEW: NUMBER OF CONVEX CURVED PARTS PROTRUDING DOWNWARD (D) | RADIUS OF CURVATURE R OF CURVED PART mm |
|---|---|---|---|---|---|---|---|---|
| INVENTIVE EXAMPLE 1 | 0.067 | 170 | 425 | ONE | ZERO | ZERO | ZERO | (A)800 |
| INVENTIVE EXAMPLE 2 | 0.067 | 170 | 440 | ZERO | ONE | ZERO | ZERO | (B)800 |
| INVENTIVE EXAMPLE 3 | 0.077 | 170 | 270 | ZERO | ZERO | ONE | ZERO | (C)1000 |
| INVENTIVE EXAMPLE 4 | 0.077 | 170 | 270 | ZERO | ZERO | ZERO | ONE | (D)1000 |

TABLE 1-continued

| | | | | | | | | |
|---|---|---|---|---|---|---|---|---|
| COMPARATIVE EXAMPLE 1 | 0.209 | 170 | 425 | ONE | ZERO | ZERO | ZERO | (A)800 |
| COMPARATIVE EXAMPLE 2 | 0.209 | 170 | 450 | ZERO | ONE | ZERO | ZERO | (B)800 |
| COMPARATIVE EXAMPLE 3 | 0.067 | 170 | 425 | ONE | ZERO | ZERO | ZERO | (C)800 |
| COMPARATIVE EXAMPLE 4 | 0.067 | 170 | 440 | ZERO | ONE | ZERO | ZERO | (D)800 |
| INVENTIVE EXAMPLE 5 | 0.067 | 170 | 465 | ONE | ZERO | ZERO | ZERO | 140 |
| INVENTIVE EXAMPLE 6 | 0.077 | 170 | 270 | ZERO | ZERO | ONE | ZERO | 200 |
| INVENTIVE EXAMPLE 7 | 0.077 | 170 | 270 | ZERO | ZERO | ZERO | ONE | 200 |
| INVENTIVE EXAMPLE 8 | 0.067 | 220 | 700 | TWO PARTS | ZERO | ZERO | ZERO | 140 (TWO PARTS) |
| INVENTIVE EXAMPLE 9 | 0.067 | 170 | 465 | ONE | ZERO | ZERO | ZERO | 140 |
| INVENTIVE EXAMPLE 10 | 0.067 | 170 | 465 | ONE | ZERO | ZERO | ZERO | 140 |
| INVENTIVE EXAMPLE 11 | 0.067 | 170 | 465 | ONE | ZERO | ZERO | ZERO | 140 |
| INVENTIVE EXAMPLE 12 | 0.067 | 170 | 465 | ONE | ZERO | ZERO | ZERO | 140 |
| INVENTIVE EXAMPLE 13 | 0.067 | 170 | 465 | ONE | ZERO | ZERO | ZERO | 140 |
| INVENTIVE EXAMPLE 14 | 0.067 | 170 | 465 | ONE | ZERO | ZERO | ZERO | 140 |
| INVENTIVE EXAMPLE 15 | 0.067 | 170 | 465 | ONE | ZERO | ZERO | ZERO | 140 |
| INVENTIVE EXAMPLE 16 | 0.067 | 170 | 465 | ONE | ZERO | ZERO | ZERO | 140 |
| INVENTIVE EXAMPLE 17 | 0.043 | 170 | 465 | ONE | ZERO | ONE | ZERO | 140, 1000 |

| | MANUFACTURING CONDITIONS | | | | ASSESSMENTS AFTER FORMING | | | | | |
|---|---|---|---|---|---|---|---|---|---|---|
| EXAMPLE | VERTICALLY-REVERSING CROSS-SECTIONAL ANGLE | REVERSE FORMING PRESS TOOLING | PREFORMING | POST-WORKING | WRINKLING IN TOP PLATE | CRACK IN TOP PLATE | WRINKLING IN VERTICAL WALL | CRACK IN VERTICAL WALL | WRINKLING IN FLANGE | CRACK IN FLANGE |
| INVENTIVE EXAMPLE 1 | 30° | FIG. 4 | NOT PERFORMED | NOT PERFORMED | NOT FOUND | NOT FOUND | NOT FOUND | NOT FOUND | NOT FOUND | NOT FOUND |
| INVENTIVE EXAMPLE 2 | 30° | FIG. 3 | NOT PERFORMED | NOT PERFORMED | NOT FOUND | NOT FOUND | NOT FOUND | NOT FOUND | NOT FOUND | NOT FOUND |
| INVENTIVE EXAMPLE 3 | 30° | FIG. 5 | NOT PERFORMED | NOT PERFORMED | NOT FOUND | NOT FOUND | NOT FOUND | NOT FOUND | NOT FOUND | NOT FOUND |
| INVENTIVE EXAMPLE 4 | 30° | FIG. 6 | NOT PERFORMED | NOT PERFORMED | NOT FOUND | NOT FOUND | NOT FOUND | NOT FOUND | NOT FOUND | NOT FOUND |
| COMPARATIVE EXAMPLE 1 | 85° | FIG. 4 | NOT PERFORMED | NOT PERFORMED | NOT FOUND | NOT FOUND | FOUND | NOT FOUND | NOT FOUND | NOT FOUND |
| COMPARATIVE EXAMPLE 2 | 85° | FIG. 3 | NOT PERFORMED | NOT PERFORMED | NOT FOUND | NOT FOUND | FOUND | NOT FOUND | NOT FOUND | NOT FOUND |
| COMPARATIVE EXAMPLE 3 | −20° | — | NOT PERFORMED | NOT PERFORMED | FOUND | NOT FOUND | NOT FOUND | NOT FOUND | NOT FOUND | NOT FOUND |
| COMPARATIVE EXAMPLE 4 | −30° | — | NOT PERFORMED | NOT PERFORMED | FOUND | NOT FOUND | NOT FOUND | NOT FOUND | NOT FOUND | NOT FOUND |
| INVENTIVE EXAMPLE 5 | 50° | FIG. 4 | NOT PERFORMED | NOT PERFORMED | NOT FOUND | NOT FOUND | NOT FOUND | NOT FOUND | NOT FOUND | NOT FOUND |
| INVENTIVE EXAMPLE 6 | 45° | FIG. 5 | NOT PERFORMED | NOT PERFORMED | NOT FOUND | NOT FOUNO | NOT FOUND | NOT FOUND | NOT FOUND | NOT FOUND |

TABLE 1-continued

| | | | | | | | | | | |
|---|---|---|---|---|---|---|---|---|---|---|
| INVENTIVE EXAMPLE 7 | 45° | FIG. 6 | NOT PER-FORMED | NOT PER-FORMED | NOT FOUND | NOT FOUND | NOT FOUND | NOT FOUND | NOT FOUND | NOT FOUND |
| INVENTIVE EXAMPLE 8 | 50° | FIG. 4 | NOT PER-FORMED | NOT PER-FORMED | NOT FOUND | NOT FOUND | NOT FOUND | NOT FOUND | NOT FOUND | NOT FOUND |
| INVENTIVE EXAMPLE 9 | 20° | FIG. 4 | NOT PER-FORMED | NOT PER-FORMED | NOT FOUND | NOT FOUND | NOT FOUND | NOT FOUND | NOT FOUND | NOT FOUND |
| INVENTIVE EXAMPLE 10 | 30° | FIG. 4 | NOT PER-FORMED | NOT PER-FORMED | NOT FOUND | NOT FOUND | NOT FOUND | NOT FOUND | NOT FOUND | NOT FOUND |
| INVENTIVE EXAMPLE 11 | 40° | FIG. 4 | NOT PER-FORMED | NOT PER-FORMED | NOT FOUND | NOT FOUND | NOT FOUND | NOT FOUND | NOT FOUND | NOT FOUND |
| INVENTIVE EXAMPLE 12 | 60° | FIG. 4 | NOT PER-FORMED | NOT PER-FORMED | NOT FOUND | NOT FOUND | NOT FOUND | NOT FOUND | NOT FOUND | NOT FOUND |
| INVENTIVE EXAMPLE 13 | 70° | FIG. 4 | NOT PER-FORMED | NOT PER-FORMED | NOT FOUND | NOT FOUND | NOT FOUND | NOT FOUND | NOT FOUND | NOT FOUND |
| INVENTIVE EXAMPLE 14 | 20° | FIG. 4 | NOT PER-FORMED | NOT PER-FORMED | NOT FOUND | NOT FOUND | NOT FOUND | NOT FOUND | NOT FOUND | NOT FOUND |
| INVENTIVE EXAMPLE 15 | 30° | FIG. 4 | PER-FORMED | NOT PER-FORMED | NOT FOUND | NOT FOUND | NOT FOUND | NOT FOUND | NOT FOUND | NOT FOUND |
| INVENTIVE EXAMPLE 16 | 30° | FIG. 4 | NOT PER-FORMED | PER-FORMED | NOT FOUND | NOT FOUND | NOT FOUND | NOT FOUND | NOT FOUND | NOT FOUND |
| INVENTIVE EXAMPLE 17 | 40° | FIG. 4 | NOT PER-FORMED | NOT PER-FORMED | NOT FOUND | NOT FOUND | NOT FOUND | NOT FOUND | NOT FOUND | NOT FOUND |

The press-formed articles in the inventive examples 1 to 4 were manufactured by performing pad draw forming after pad holding was completed with a vertically-reversing cross-sectional angle of 30° using the reverse forming press toolings shown in FIGS. 4, 3, 5 and 6, respectively. As a result, no crack or wrinkling occurred in any of the top plate, the vertical walls and the flanges, and the press-formed articles were able to be satisfactorily formed.

In the comparative examples 1 and 2, the variation in height of the vertical walls was 190 mm, and pad holding was achieved with a vertically-reversing cross-sectional angle of 85°. As a result, a wrinkling occurred in the vertical walls.

In the comparative examples 3 and 4, the reverse-forming press tooling was not used, and pad holding was achieved with vertically-reversing cross-sectional angles of −20° and −30°, respectively. As a result, a wrinkling occurred in the top plate.

The press-formed articles in the inventive examples 5 to 8 were manufactured by performing pad draw forming after pad holding was completed with vertically-reversing cross-sectional angles of 50°, 45°, 45° and 50° using the reverse forming press toolings shown in FIGS. 4, 5, 6 and 4, respectively. As a result, no crack or wrinkling occurred in any of the top plate, the vertical walls and the flanges, and the press-formed articles were able to be satisfactorily formed.

In the inventive examples 9 to 14, the material and type of the blank were modified, and the press-formed articles were manufactured by performing pad draw forming after pad holding was completed with vertically-reversing cross-sectional angles of 20°, 30°, 500, 60°, 70° and 20°, respectively, using the reverse forming press tooling shown in FIG. 4. As a result, no crack or wrinkling occurred in any of the top plate, the vertical walls and the flanges, and the press-formed articles were able to be satisfactorily formed.

In the inventive example 15, stamping, which uses an upper die and a lower die having a surface offset by the thickness of the sheet from the forming surface of the upper die, was performed as a preforming to form the seating faces on the top plate. The press-formed article was manufactured by performing pad draw forming after pad holding was completed with a vertically-reversing cross-sectional angle of 30° using the reverse forming press tooling shown in FIG. 4. As a result, no crack or wrinkling occurred in any of the top plate, the vertical walls and the flanges, and the press-formed articles were able to be satisfactorily formed.

In the inventive example 16, restriking, which uses an upper die and a lower die having a surface offset by the thickness of the sheet from the forming surface of the upper die, was performed as a post-working to provide a shaped bead. The press-formed article was manufactured by performing pad draw forming after pad holding was completed with a vertically-reversing cross-sectional angle of 30° using the reverse forming press tooling shown in FIG. 4. As a result, no crack or wrinkling occurred in any of the top plate, the vertical walls and the flanges, and the press-formed articles were able to be satisfactorily formed.

Furthermore, the press-formed article in the inventive example 17 was manufactured by performing pad draw forming after pad holding was completed with a vertically-reversing cross-sectional angle of 40° using the reverse forming press tooling shown in FIG. 4. As a result, no crack or wrinkling occurred in any of the top plate, the vertical walls and the flanges, and the press-formed articles were able to be satisfactorily formed.

REFERENCE SIGNS LIST

10 manufacturing apparatus according to the present invention

11 punch

12 blank holder
12*a* contacting surface
13 pad
13*a* contacting surface
14 die
15 blank
20, 20A to 20M press-formed article
21 top plate
22 ridge
23 vertical wall
24 curved part
flange
26 first part
27 second part

The invention claimed is:

1. A method of manufacturing a press-formed article, the method using a punch and a blank holder and a pad and a die arranged to be opposed to the punch and the blank holder, and the press-formed article being manufactured by pressing a metal sheet having a tensile strength of 400 MPa or more, which is a steel sheet, an aluminum sheet or an aluminum alloy sheet, disposed between the punch and the blank holder and the pad and the die, wherein the press-formed article extends in a first direction, has a shape defined by a top plate, a ridge connected to the top plate, a vertical wall connected to the ridge and a flange connected to the vertical wall in each of press directional cross sections that are along a direction of pressing and intersect the first direction, has at least one curved part that is curved in the first direction in one or both of top view in the direction of pressing and side view in a direction intersecting the direction of pressing, and has a first part including the curved part and a second part continuous to the first part, a minimum height of the vertical wall in the second part is equal to or more than a maximum height of the vertical wall in the first part, the method comprises a first step in which a pad holding state is established and a second step in which pad draw forming is performed using the punch and the blank holder and the pad and the die after the first step is completed, and in the pad holding state, a part of the metal sheet to be formed into the top plate is held between the pad and the punch, and a part of the metal sheet to be formed into the flange is held between the die and the blank holder, of the press directional cross sections, in a specific press directional cross section of a part of the metal sheet to be formed into the first part, a position of a contacting surface of the blank holder that makes contact with the metal sheet in the direction of pressing is located higher than a contacting surface of the pad when the punch and the blank holder are arranged below the blank and the pad and the die are arranged above the blank, or the contacting surface of the blank holder is located lower than the contacting surface of the pad when the punch and the blank holder are arranged above the blank and the pad and the die are arranged below the blank, a vertically-reversing cross-sectional angle, which is an acute angle formed by a straight line that connects a center of a rounded end part of the contacting surface of the pad and a center of a rounded end part of the contacting surface of the blank holder and an extension of the contacting surface of the pad that makes contact with the metal sheet, is more than 0° and equal to or less than 80°, and of the press directional cross sections, in a press directional cross section that is different from the specific press directional cross section, the position of the contacting surface of the pad that makes contact with the metal sheet in the direction of the pressing is located higher than the contacting surface of the blank holder when the punch and the blank holder are arranged below the blank and the pad and the die are arranged above the blank or the contacting surface of the pad is located lower than the contacting surface of the blank holder when the punch and the blank holder are arranged above the blank and the pad and the die are arranged below the blank.

2. The method of manufacturing a press-formed article according to claim 1, wherein in the first step, in the specific press directional cross section, the blank holder is placed at a height equal to or higher than a minimum height of the vertical wall, and the die is the first to start forming the metal sheet.

3. The method of manufacturing a press-formed article according to claim 1, wherein in a cross section in the direction of pressing of at least a part in the first direction, the pad is the first to start forming the metal sheet.

4. The method of manufacturing a press-formed article according to claim 1, wherein the metal sheet is an intermediate worked article formed from a starting metal sheet by a preforming.

5. A method of manufacturing a press-formed article, wherein a post-forming is performed on a press-formed article manufactured in the manufacturing method according to claim 1.

6. An apparatus for manufacturing a press-formed article, the apparatus comprising a punch and a blank holder and a pad and a die arranged to be opposed to the punch and the blank holder, and the press-formed article being manufactured by pressing a metal sheet having a tensile strength of 400 MPa or more, which is a steel sheet, an aluminum sheet or an aluminum alloy sheet, disposed between the punch and the blank holder and the pad and the die, wherein the press-formed article extends in a first direction, has a shape defined by a top plate, a ridge connected to the top plate, a vertical wall connected to the ridge and a flange connected to the vertical wall in each of press directional cross sections that are along a direction of pressing and intersect the first direction, has at least one curved part that is curved in the first direction in one or both of top view in the direction of pressing and side view in a direction intersecting the direction of pressing, and has a first part including the curved part and a second part continuous to the first part, a minimum height of the vertical wall in the second part is equal to or more than a maximum height of the vertical wall in the first part, the apparatus configured to manufacture the press-formed article in a first step in which a pad holding state is established and a second step in which pad draw forming is performed using the punch and the blank holder and the pad and the die after the first step is completed, and in the pad holding state, a part of the metal sheet to be formed into the top plate is held between the pad and the punch, and a part of the metal sheet to be formed into the flange is held between the die and the blank holder, of the press directional cross sections, in a specific press directional cross section of a part of the metal sheet to be formed into the first part, a position of a contacting surface of the blank holder that makes contact with the metal sheet in the direction of pressing is located higher than a contacting surface of the pad when the punch and the blank holder are arranged below the blank and the pad and the die are arranged above the blank, or the contacting surface of the blank holder is located lower than the contacting surface of the pad when the punch and the blank holder are arranged above the blank and the pad and the die are arranged below the blank, a vertically-reversing cross-sectional angle, which is an acute angle formed by a straight line that connects a center of a rounded end part of the contacting surface of the pad and a center of a rounded end part of the contacting surface of the blank holder and an extension of the contacting surface of the pad that makes contact with the metal sheet, is more than 0° and equal to or less than 80°, and of the press directional cross sections, in a press directional cross section that is different from the specific press directional cross section, the position of the contacting surface of the pad that makes contact with the metal sheet in the direction of the pressing is located higher than the contacting surface of the blank holder when the punch and the blank holder are arranged below the blank and the pad and the die are arranged above the blank or the contacting surface of the pad is located lower than the contacting surface of the blank holder when the punch and the blank holder are arranged above the blank and the pad and the die are arranged below the blank.

* * * * *